US010209025B2

(12) United States Patent
Tiberius et al.

(10) Patent No.: US 10,209,025 B2
(45) **Date of Patent: *Feb. 19, 2019**

(54) PNEUMATIC SYSTEM AND METHOD FOR SIMULATED FIREARM TRAINING

(71) Applicant: TIBERIUS TECHNOLOGY, LLC, Alpine, UT (US)

(72) Inventors: Benjamin T. Tiberius, Highland, UT (US); Jonathan S. Willson, Cecil, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/660,700

(22) Filed: Jul. 26, 2017

(65) Prior Publication Data

US 2018/0010878 A1 Jan. 11, 2018

Related U.S. Application Data

(63) Continuation of application No. 14/157,336, filed on Jan. 16, 2014, now Pat. No. 9,719,747.

(Continued)

(51) Int. Cl.
*F41A 17/36* (2006.01)
*F41A 17/40* (2006.01)

(Continued)

(52) U.S. Cl.
CPC ..... *F41A 33/04* (2013.01); *F41A 11/02* (2013.01); *F41A 33/02* (2013.01); *F41A 33/06* (2013.01);

(Continued)

(58) Field of Classification Search
CPC ..... F41A 33/00; F41A 33/02; F41A 33/04; F41A 33/06; F41A 17/36; F41A 17/40;

(Continued)

(56) References Cited

U.S. PATENT DOCUMENTS 6,532,947 B1 * 3/2003 Rosa ..... F42B 12/40 124/56
6,682,350 B2 * 1/2004 Kehl ..... F41A 33/02 42/114

(Continued)

FOREIGN PATENT DOCUMENTS

DE 655334 1/1938
RU 213631 1/1997
WO WO 2010065124 A1 * 6/2010 ..... F41A 33/02

OTHER PUBLICATIONS

Translation of German Patent No. 655334 published by U.S. Patent and Trademark Office in May 2014, 9 pages.

*Primary Examiner* — Bayan Salone
(74) *Attorney, Agent, or Firm* — Pate Peterson, PLLC; Warren M. Pate

(57) ABSTRACT

A training method and apparatus are disclosed. The training method may include converting a firearm capable of firing live ammunition to a pneumatic training device incapable of firing live ammunition. The training method may further include cycling a pneumatic training device through one or more cycles. Each of the cycles may simulate an actual firing of the firearm. Each of the cycles may also include triggering a trigger assembly of the pneumatic training device, using a charge of a pressurized gas to reset the trigger assembly, and advancing a counter of the pneumatic training device. After a certain number of cycles have been completed, a next cycle may be attempted, but not completed. Accordingly, the training method may enable a user to safely and realistically practice reloading, jam or malfunction clearing, or the like.

13 Claims, 25 Drawing Sheets

Related U.S. Application Data

(60) Provisional application No. 61/753,426, filed on Jan. 16, 2013, provisional application No. 61/884,858, filed on Sep. 30, 2013.

(51) Int. Cl.

| | |
|---|---|
| ***F41A 33/00*** | (2006.01) |
| ***F41A 33/02*** | (2006.01) |
| ***F41A 33/04*** | (2006.01) |
| ***F41A 33/06*** | (2006.01) |
| ***F41A 9/62*** | (2006.01) |
| ***F41A 19/01*** | (2006.01) |
| ***F41A 21/26*** | (2006.01) |
| ***F41B 11/62*** | (2013.01) |
| ***F41A 11/02*** | (2006.01) |
| *F41B 11/722* | (2013.01) |

(52) U.S. Cl.
CPC ..... *F41A 9/62* (2013.01); *F41A 17/36* (2013.01); *F41A 19/01* (2013.01); *F41A 21/26* (2013.01); *F41A 33/00* (2013.01); *F41B 11/62* (2013.01); *F41B 11/722* (2013.01); *Y10T 29/49716* (2015.01)

(58) Field of Classification Search
CPC .. F41A 9/62; F41A 19/01; F41A 21/26; F41B 11/62; F41B 11/722; Y10T 29/49716
USPC ..... 29/401.1; 434/11, 16, 18, 24
See application file for complete search history.

(56) References Cited

U.S. PATENT DOCUMENTS

| | | | | |
|---|---|---|---|---|
| 6,869,285 | B1 * | 3/2005 | Jones, II | G09B 19/00 42/10 |
| 7,306,462 | B2 * | 12/2007 | Metcalfe | F41A 33/06 137/625.2 |
| 7,591,261 | B2 * | 9/2009 | Wei | F41B 11/56 124/45 |
| 8,602,784 | B2 * | 12/2013 | Dvorak | F41A 33/02 434/11 |
| 8,899,985 | B2 * | 12/2014 | Walls | F41A 3/68 434/24 |
| 9,151,565 | B2 * | 10/2015 | Peterson | F41A 33/06 |
| 9,719,747 | B2 * | 8/2017 | Tiberius | F41A 33/02 |
| 2012/0129136 | A1 * | 5/2012 | Dvorak | F41A 33/02 434/18 |
| 2012/0132187 | A1 * | 5/2012 | Murray | F41A 9/37 124/77 |
| 2013/0108991 | A1 * | 5/2013 | Walls | F41A 3/68 434/24 |
| 2014/0196267 | A1 * | 7/2014 | Tiberius | F41A 33/02 29/401.1 |
| 2017/0065577 | A1 | 3/2017 | Quinlan et al. | |

* cited by examiner

PNEUMATIC SYSTEM AND METHOD FOR SIMULATED FIREARM TRAINING

RELATED APPLICATIONS

This application is a continuation of U.S. patent application Ser. No. 14/157,336 filed Jan. 16, 2014 (now U.S. Pat. No. 9,719,747), which claims the benefit of (1) U.S. Provisional Patent Application Ser. No. 61/753,426 filed Jan. 16, 2013 and (2) U.S. Provisional Patent Application Ser. No. 61/884,858 filed Sep. 30, 2013.

U.S. patent application Ser. No. 14/157,336, U.S. Provisional Patent Application Ser. No. 61/753,426, and U.S. Provisional Patent Application Ser. No. 61/884,858 are each hereby incorporated by reference.

BACKGROUND

1. The Field of the Invention

This invention relates to firearms and, more particularly, to novel systems and methods for converting a firearm to a pneumatic training device.

2. The Background Art

Live ammunition for firearms is relatively expensive. Moreover, training with live ammunition carries with it certain inherent dangers. Accordingly, what is need are training solutions that do not involve live ammunition, but still provide a high degree of realism.

BRIEF SUMMARY OF THE INVENTION

In view of the foregoing, in accordance with the invention as embodied and broadly described herein, a method and apparatus are disclosed in one embodiment of the present invention as including a device for simulated firearm training. In certain embodiments, a training device in accordance with the present invention may comprise a firearm modified to support pneumatic actuation of one or more components thereof. This pneumatic actuation may simulate the actual firing of the firearm. Accordingly, a training device may be an effective and safe training tool.

In selected embodiments, a training device may include a magazine assembly and an actuator assembly. To convert a firearm into a training device in accordance with the present invention, a magazine assembly may be substitute in place of a conventional magazine. An actuator assembly may be substituted in place of a barrel, bolt, bolt carrier group, or some other portion of an action of a firearm.

Once a training device has been fully assembled, actuation of a trigger assembly may result in a pneumatic actuation of an action of the training device. In selected embodiments, this may be accomplished by the actuator assembly using compressed fluid contained within the magazine assembly. In certain embodiments, the actuation of a trigger assembly may also result in a popping sound as compressed fluid (e.g., gas) escapes from an actuator assembly. Thus, a training device may simulate the sounds, actuations, recoil, or the like associate with an actual firing of the corresponding firearm.

In selected embodiments, a magazine assembly may include a counter. A counter may count actuations or cycles of an action of a training device. Accordingly, after a certain number of actuations or cycles, a counter may stop, prevent, or block the completion of further actuations or cycles. In certain embodiments, this may simulate a "last shot hold open" and/or force a user to execute or practice a reload.

In certain embodiments, a counter may assist in simulating a firearm malfunction. For example, in certain embodiments, a counter may include a first system, a second system, or both a first system and a second system. A first system may simulate or provide a "last shot hold open" or otherwise force a reload. A second system may simulate or provide a jam or malfunction that requires a user to execute and practice a jam or malfunction clearing drill (e.g., a "tap and rack" drill).

In selected embodiments, an actuator assembly may emit a laser pulse during a simulated firing event. Moreover, an actuator assembly may be configured to emit a laser pulse only when properly triggered and not inadvertently when the training device is dropped, the action of the training device is racked, or the like. This may be accomplished in any suitable manner. For example, in selected embodiments, pressure of a propellant may prevent an inadvertent electrical contact (and an associated laser pulse) when a training device is charged with propellant and a mechanical biasing device may prevent an inadvertent electrical contact when a training device is not charged with propellant. Thus, at no time during operation of the training device is an inadvertent electrical contact possible.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
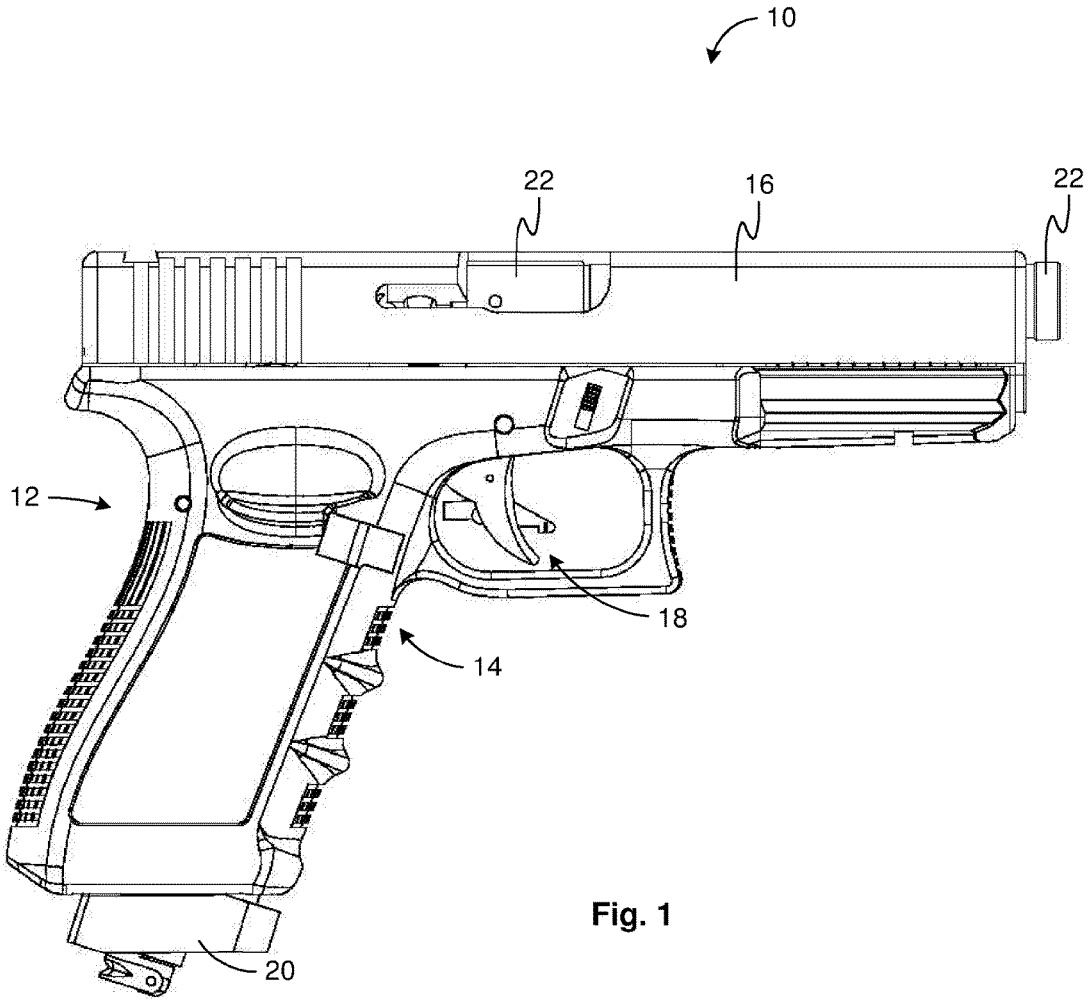
FIG. 1 is a side view of one embodiment of a pneumatic training device in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, a training device 10 in accordance with the present invention may begin as, or be built from, a firearm. For example, in a reversible process, a firearm capable of firing live ammunition may be converted to become a training device 10 that is incapable of firing live ammunition.

In selected embodiments, a training device 10 in accordance with the present invention may comprise a firearm modified to support pneumatic actuation of one or more components thereof. For example, a training device 10 may support pneumatic actuation or manipulation of an action of the firearm. In selected embodiments, this pneumatic actuation may simulate the actual firing of the firearm. Accordingly, a training device 10 in accordance with the present invention may be an effective and safe training tool.

A training device 10 may include, or be built from, any suitable firearm. Suitable firearms may include handguns, rifles, or the like. For example, as shown, a training device 10 may be built from or comprise various components, assemblies, or sub-systems of an automatic pistol 12, including a frame 14, slide 16 or bolt 16, and trigger assembly 18. In such embodiments, the conventional magazine and barrel corresponding to the automatic pistol 12 may be removed and respectively replaced with a magazine assembly 20 and an actuator assembly 22. In the illustrated embodiment, the actuator assembly 22 is shaped and positioned to occupy the space previously occupied by the barrel. A magazine assembly 20 may be inserted and released or ejected in the same manner as the magazine it replaces.

Once a training device 10 has been fully assembled, actuation of a trigger assembly 18 may result in a pneumatic actuation of the slide 16 or bolt 16. In selected embodiments, this may be accomplished by the actuator assembly 22 using compressed gas (e.g., compressed air, compressed carbon dioxide, some other compressed fluid, or the like) contained within the magazine assembly 20. In certain embodiments, the actuation of a trigger assembly 18 may also result in a popping sound (e.g., as compress gas escapes from an actuator assembly 22). Thus, a training device 10 may simulate the sounds, actuations, recoil, and the like associate with an actual firing of the corresponding firearm.

In selected embodiments, a training device 10 in accordance with the present invention may include a regulator. For example, a training device 10 may include an adjustable or non-adjustable regulator regulating a flow of gas. Thus, in certain embodiments, an actuator assembly 22 may use gas at one pressure to actuate a slide 16, bolt 16, or the like, while a magazine assembly 20 stores the gas, fluid, or the like at another, higher pressure. Such a regulator may be included as part of a magazine assembly 20, an actuator assembly 22, or some combination thereof.

Figure 2:
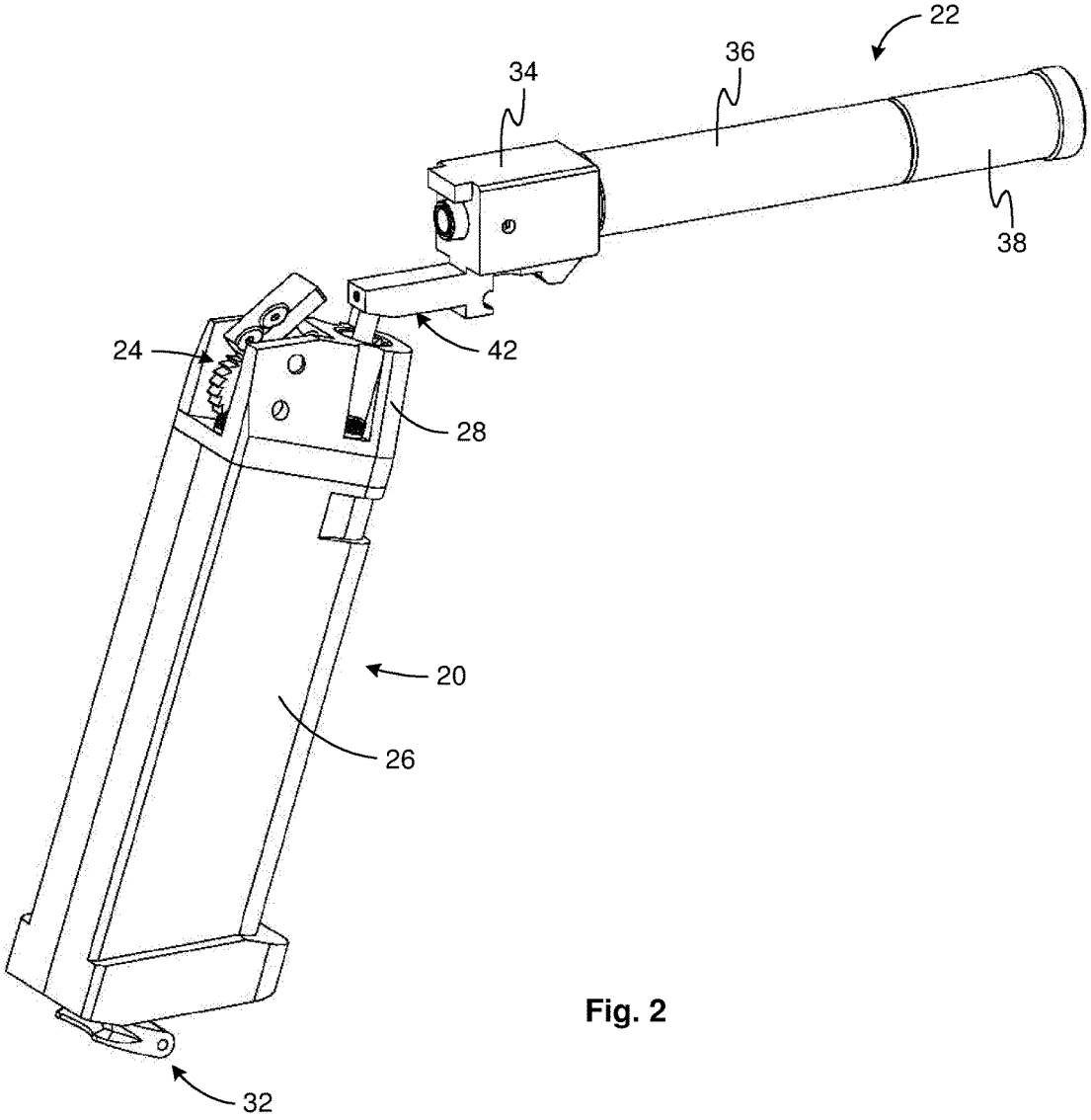
FIG. 2 is a perspective view of an actuator assembly of the training device of FIG. 1 engaging a magazine assembly of the training device of FIG. 1.
Figure 3:
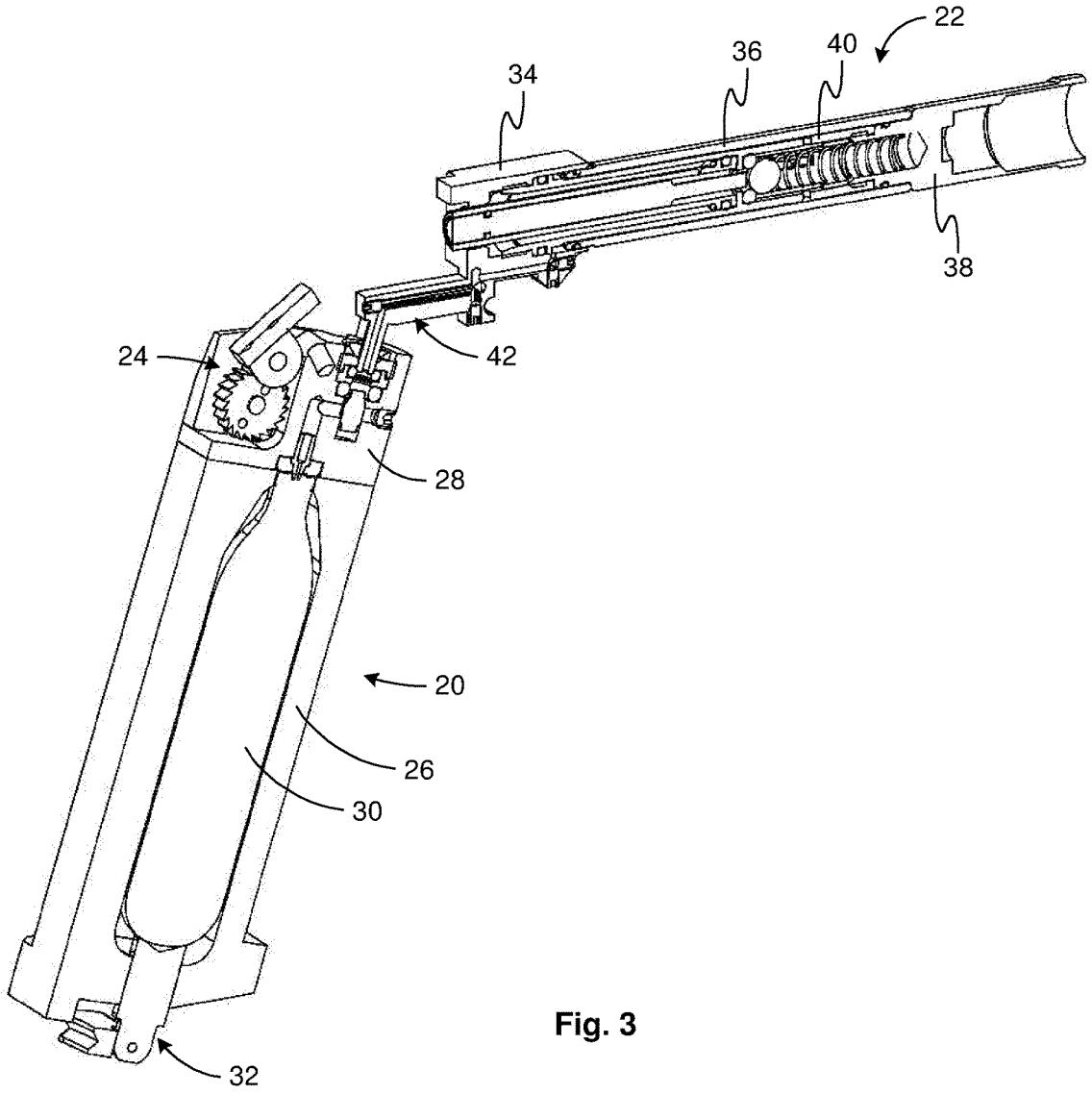
FIG. 3 is a perspective, cross-sectional view of the actuator and magazine assemblies of FIG. 2.

Referring to FIGS. 2 and 3, in selected embodiments, a magazine assembly 20 may include a counter 24, frame 26, interface 28, container 30, retainer 32, or the like or a combination or sub-combination thereof. A counter 24 may count actuations of an action (e.g., cycles of a bolt 16) of a training device 10. Accordingly, after a certain number of actuations or cycles (e.g., a number corresponding to a conventional magazine associated with the corresponding firearm), a counter 24 may stop, prevent, or block the completion of further actuations or cycles. This may be done in any suitable manner. In selected embodiments, a counter 24 may include a bolt lock that locks a slide 16 or bolt 16 back after a particular number of actuations or cycles has been reached.

A frame 26 may provide a primary or base structure for a magazine assembly 20. In selected embodiments, a frame 26 may include or define one or more apertures for containing or housing one or more containers 30. An interface 28 may support or house various mechanisms or structures of a training device 10. For example, in selected embodiments, an interface 28 may support or house a counter 24. Alternatively, or in addition thereto, an interface 28 may support or house various conduits, valves, or the like that support the communication of compressed fluid (e.g., gas) from one or more containers 30 to an actuator assembly 22.

A container 30 may contain a propellant used by an actuator assembly 22. In selected embodiments, a container 30 may container a compressed fluid. For example, in selected embodiments, a container 30 may comprise a cartridge of compressed carbon dioxide (e.g., a 12 or 16 gram cartridge). A retainer 32 may secure a container 30 in place.

An actuator assembly 22 may include a base 34, outer cylinder 36 and end cap 38. An outer cylinder 36 and end cap 38 may contain many of the inner workings of an actuator assembly 22. An outer cylinder 36 and end cap 38 may be connected in any suitable manner. In selected embodiments, an end cap 38 may thread into an inner cylinder 40 contained within an outer cylinder 36. Alternatively, an end cap 38 may be pinned to an outer cylinder 36 to preclude rotation therebetween. A base 34 may include a stem 42 extending to access the propellant used by the actuator assembly 22.

A training device 10 in accordance with the present invention may be assembled in any suitable manner. In selected embodiments, a training device 10 may be assembled quickly and easily (e.g., in the field) without the use of any tools. For example, in the illustrated embodiment, the training device 10 may be assembled by: (1) obtaining the corresponding firearm; (2) removing the slide 16 from the frame 14 of the firearm; (3) removing a recoil spring and barrel from the slide 16; (4) placing the recoil spring back into the slide 16; (5) reattaching the slide 16 to the frame 14; (6) pulling the slide 16 back against the biasing of the recoil spring to open the action of the firearm; (7) inserting the base 34 of the actuator assembly 22 into the action; (8) permitting the recoil spring to close the action and drive the base 34 into its proper location; (9) inserting the outer cylinder 36, end cap 38, and associated contents into the slide 16 through the aperture that previously surrounded the mussel of the convention barrel; (10) securing the outer cylinder 36, end cap 38, and their contents to the base 34 (e.g., threading an inner cylinder 40 contained within the outer cylinder 36 into the base 34); and (11) fully seating the magazine assembly 20 within a magazine well within the frame 14.

Figure 4:
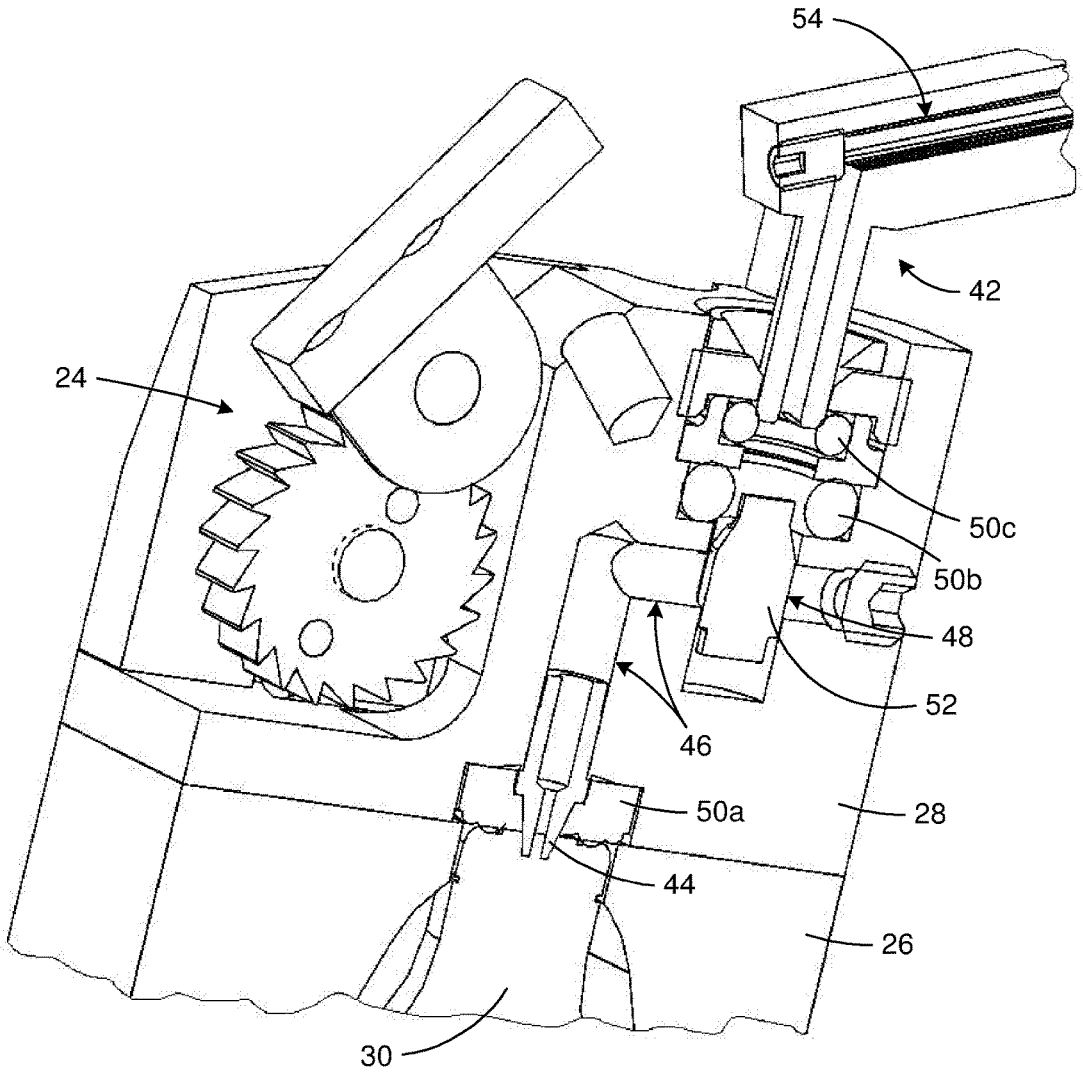
FIG. 4 is a partial perspective, cross-sectional view of the actuator and magazine assemblies of FIG. 2.
Figure 5:
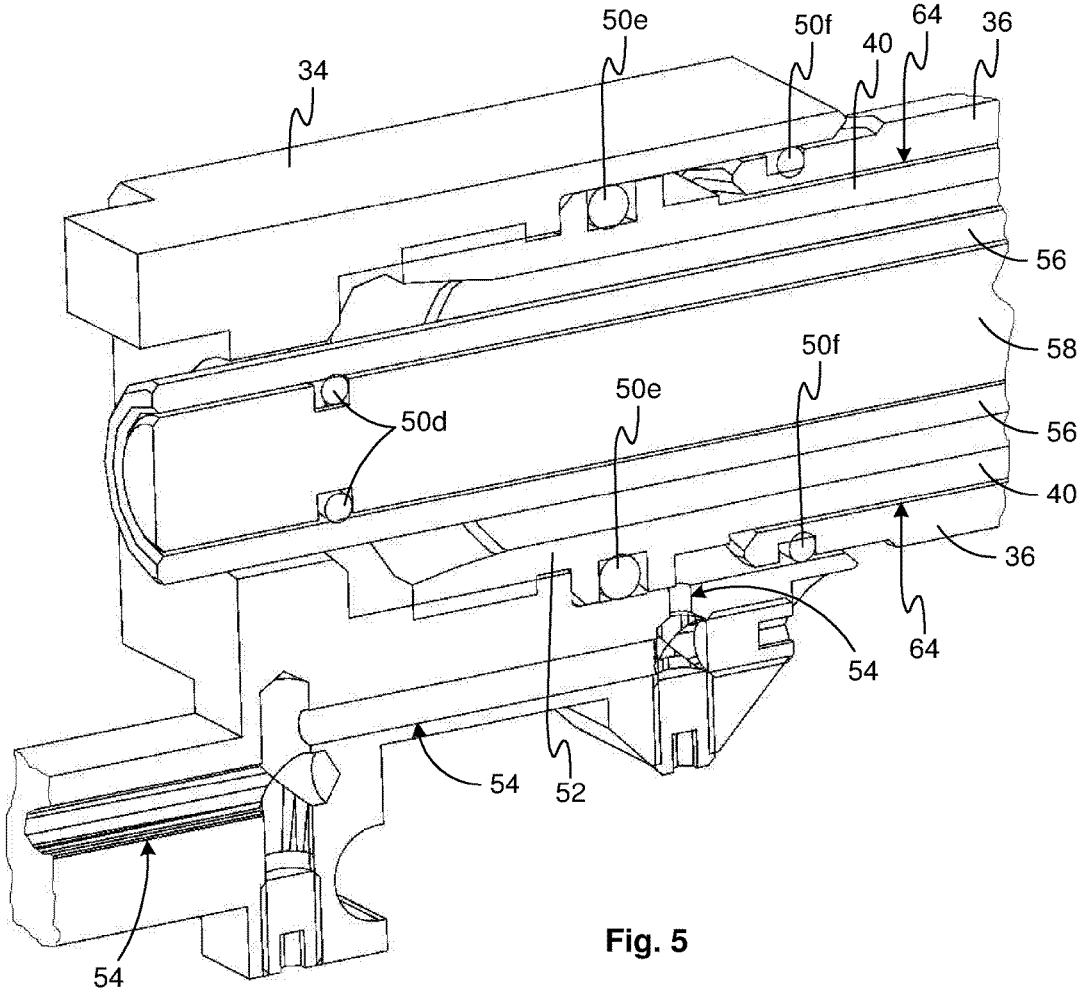
FIG. 5 is a partial perspective, cross-sectional view of the actuator assembly of FIG. 2.
Figure 6:
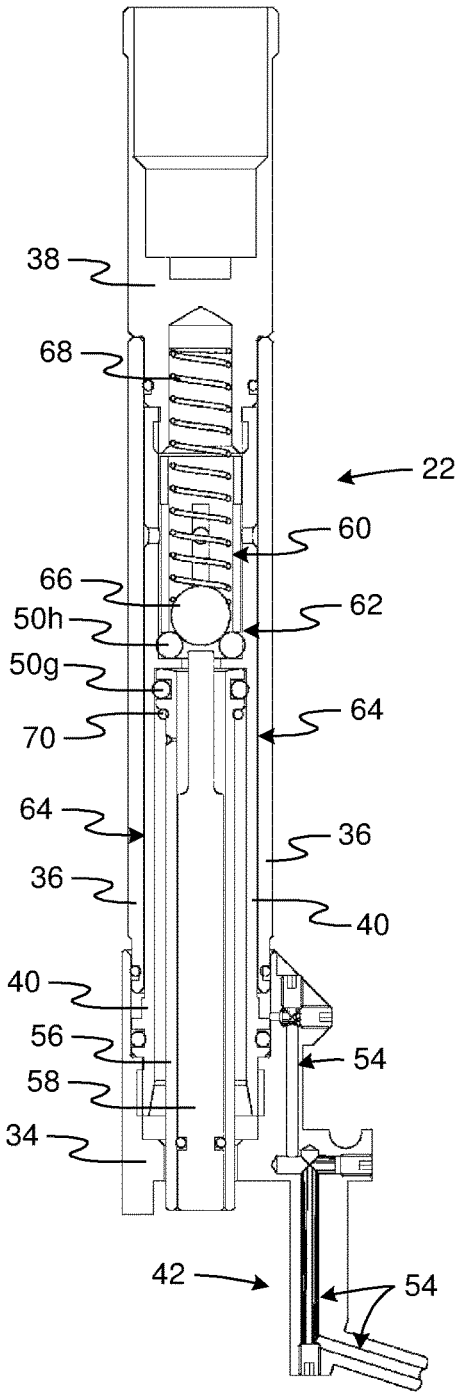
FIG. 6 is a side, cross-sectional view of the actuator assembly of FIG. 2 with the reservoir valve closed, the piston retracted, and the firing pin extension in the ready position.
Figure 7:
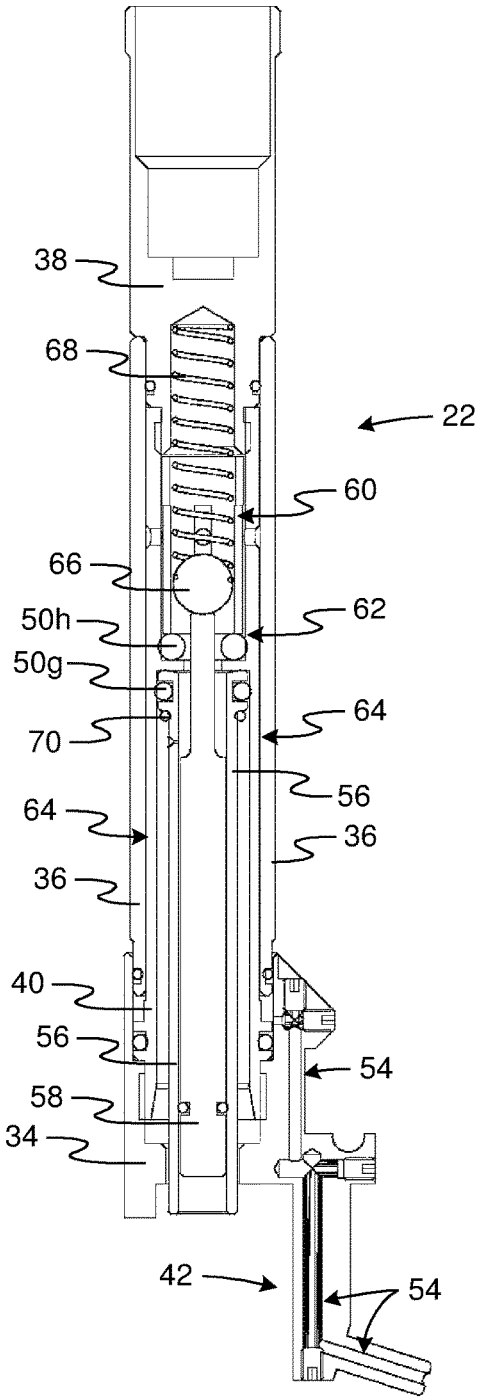
FIG. 7 is a side, cross-sectional view of the actuator assembly of FIG. 2 with the reservoir valve open, the piston retracted, and the firing pin extension in the activated position.
Figure 8:
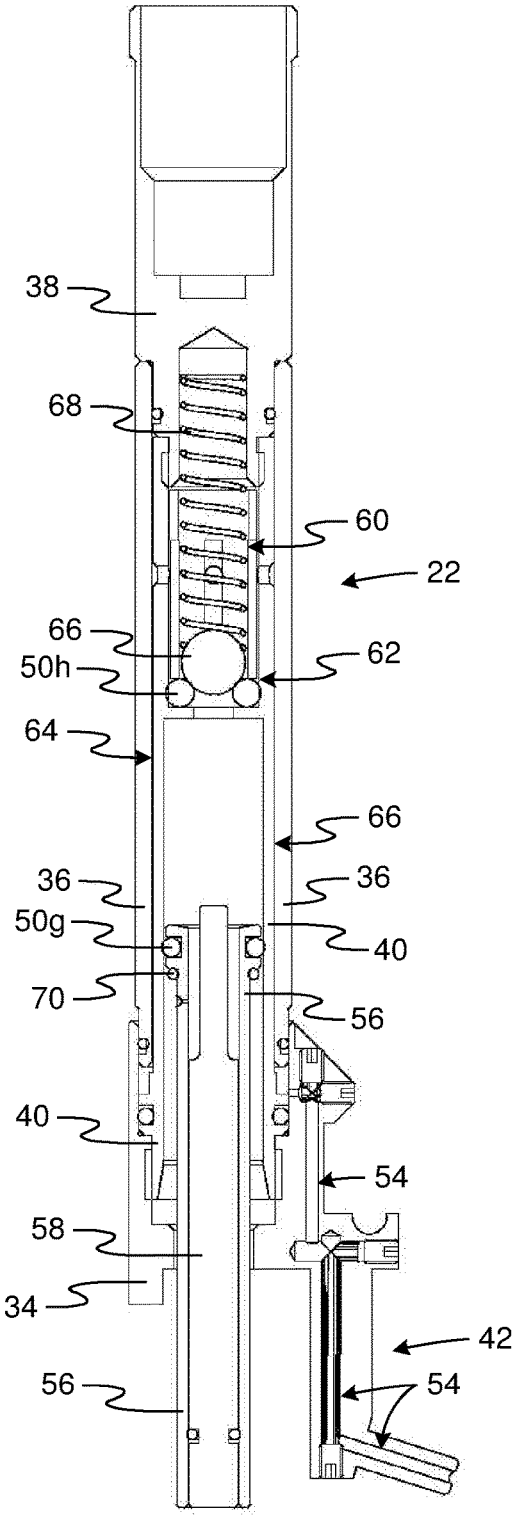
FIG. 8 is a side, cross-sectional view of the actuator assembly of FIG. 2 with the reservoir valve closed and the piston partially extended.
Figure 9:
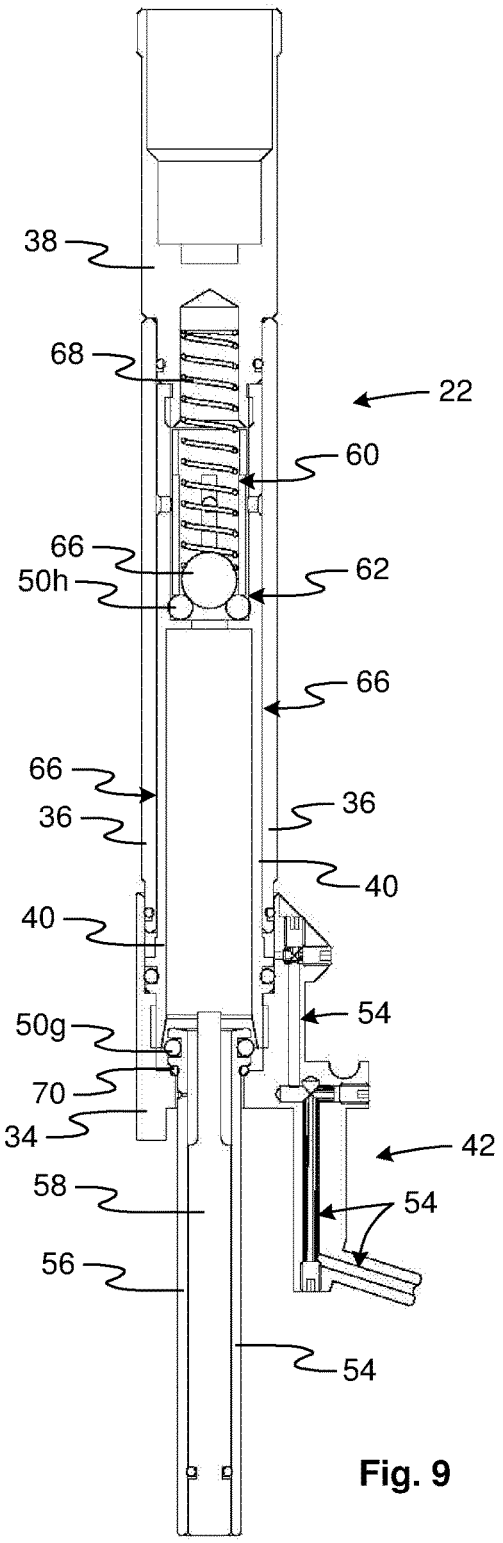
FIG. 9 is a side, cross-sectional view of the actuator assembly of FIG. 2 with the reservoir valve closed and the piston fully extended.
Figure 10:
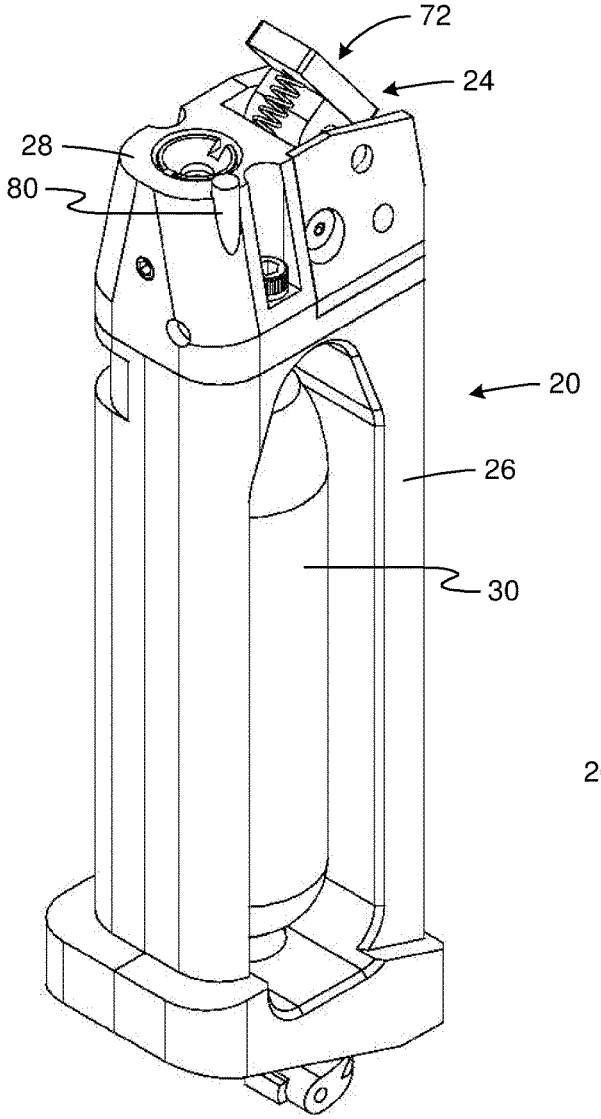
FIG. 10 is a perspective view of the magazine assembly of FIG. 2 with the bolt lock in a retracted position.
Figure 11:
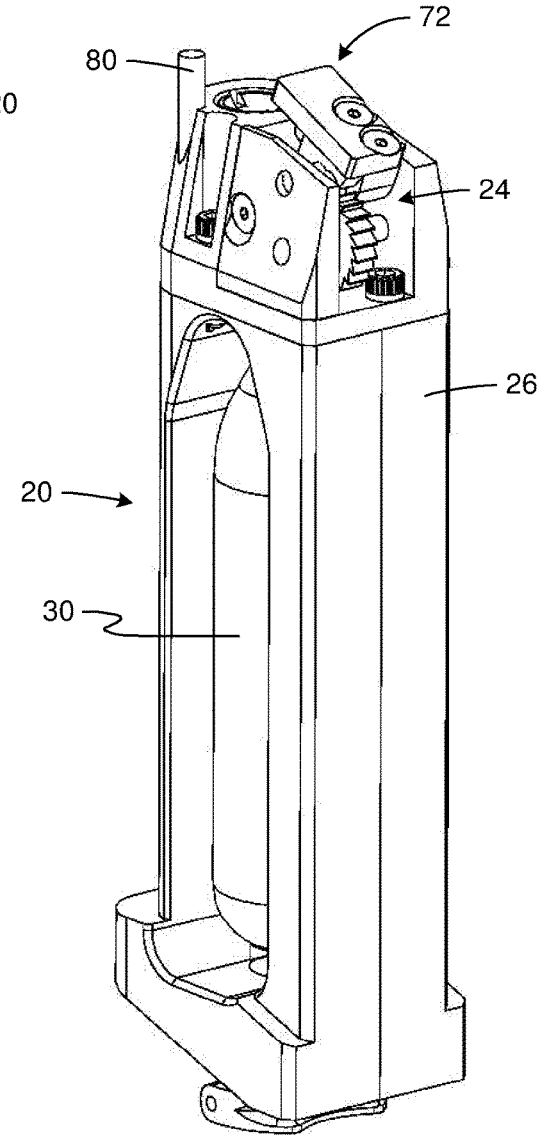
FIG. 11 is a perspective view of the magazine assembly of FIG. 2 with the bolt lock in an extended or blocking position.
Figure 12:
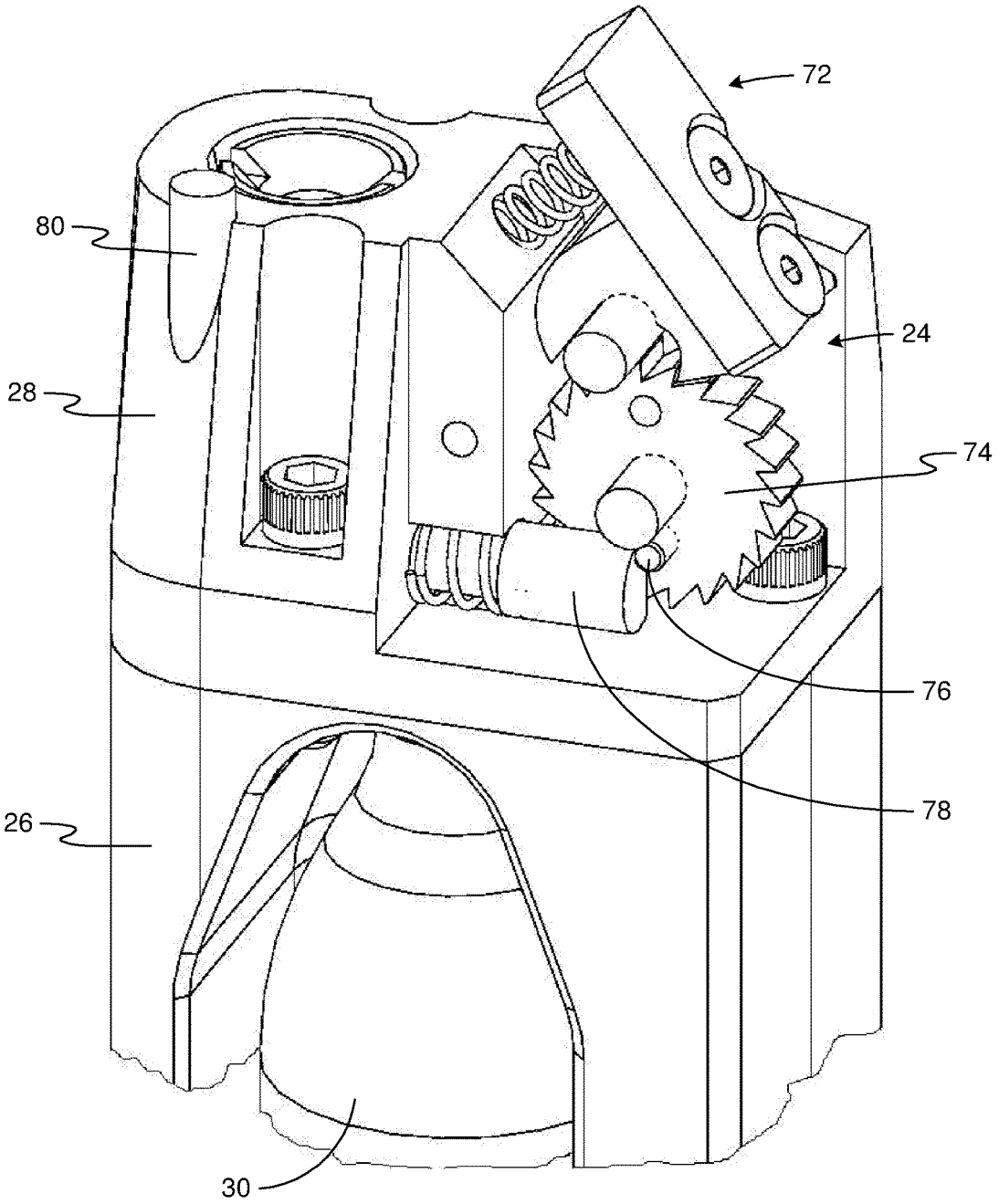
FIG. 12 is a partial perspective view the magazine assembly of FIG. 2 with the bolt lock in a retracted position and a portion of the magazine interface removed to expose a driver in a position to being actuating a latch.
Figure 13:
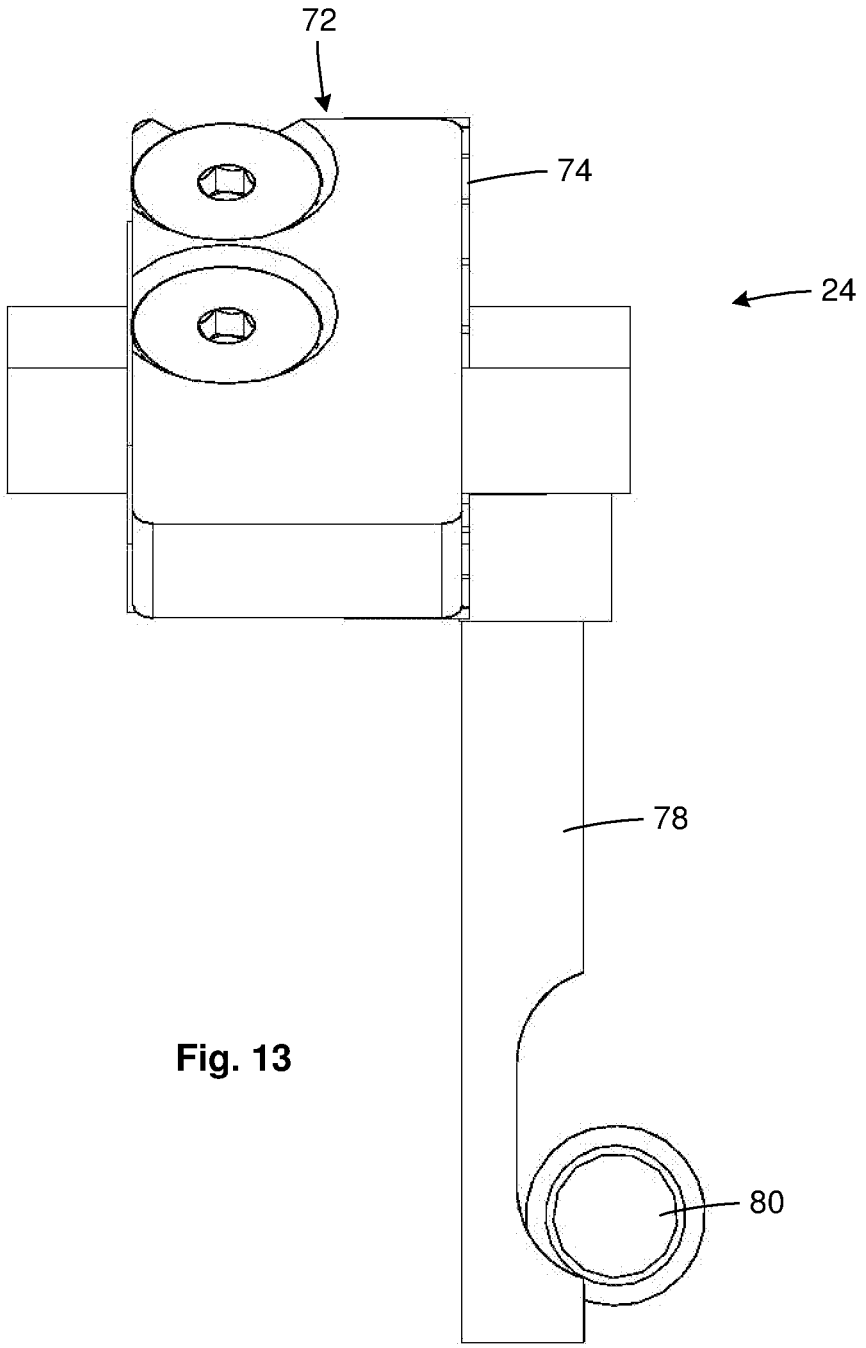
FIG. 13 is a top plan view of selected components of a counter of the magazine assembly of FIG. 2 with the bolt lock in a retracted position.
Figure 14:
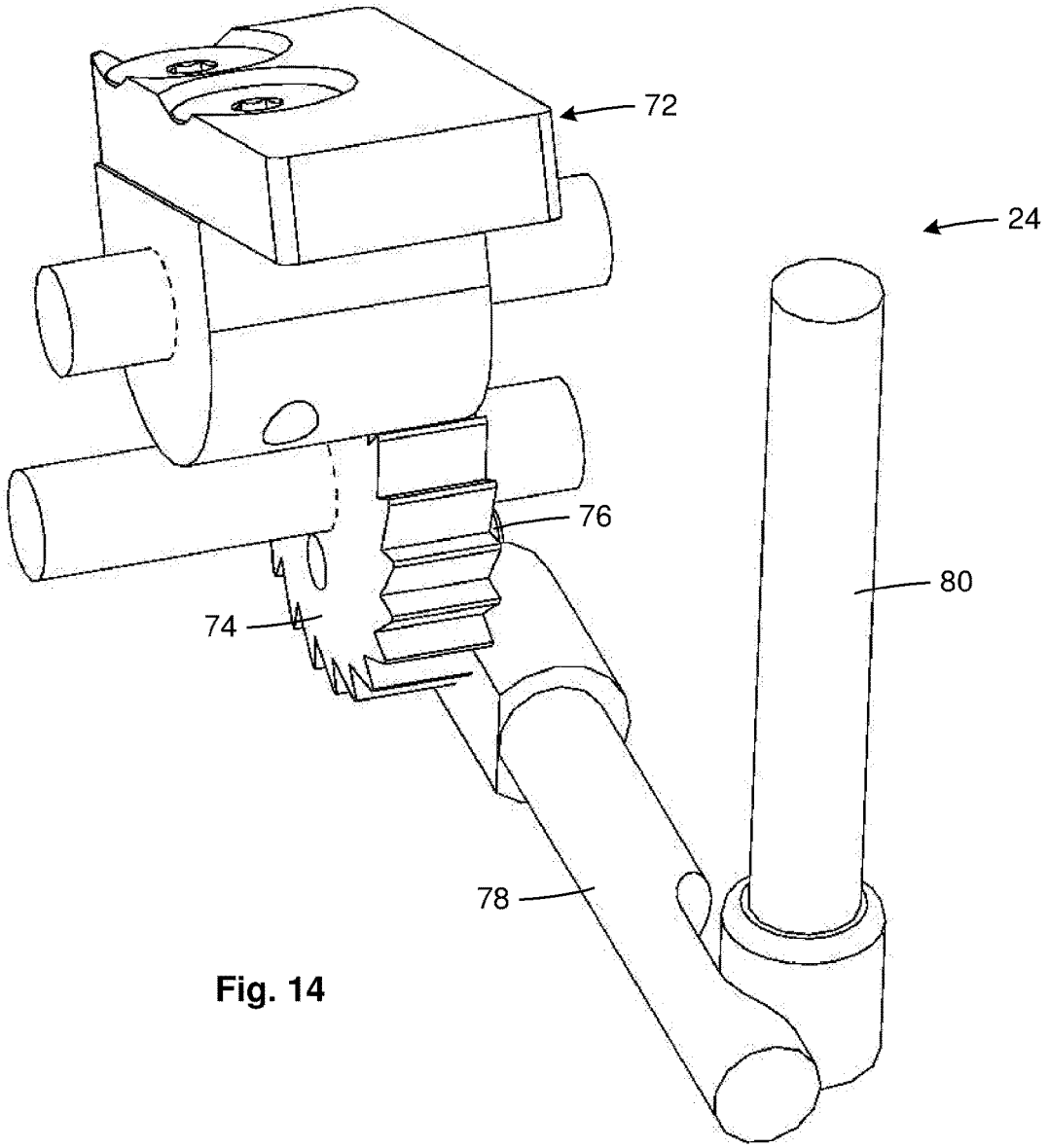
FIG. 14 is a perspective view of selected components of the counter of the magazine assembly of FIG. 2 with the bolt lock in an extended or blocking position.
Figure 15:
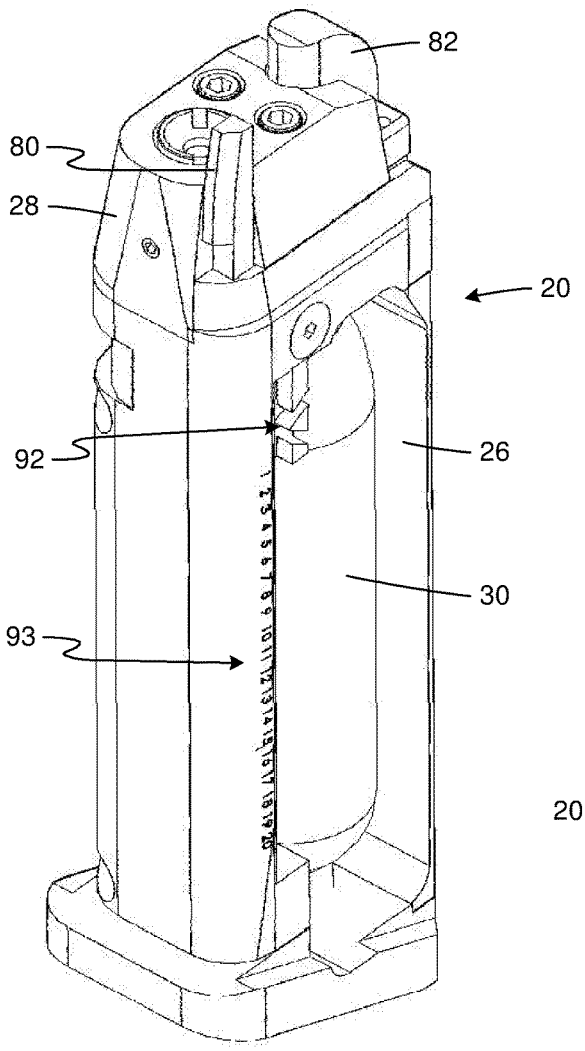
FIG. 15 is a perspective view of an alternative embodiment of a magazine assembly in accordance with the present invention.
Figure 16:
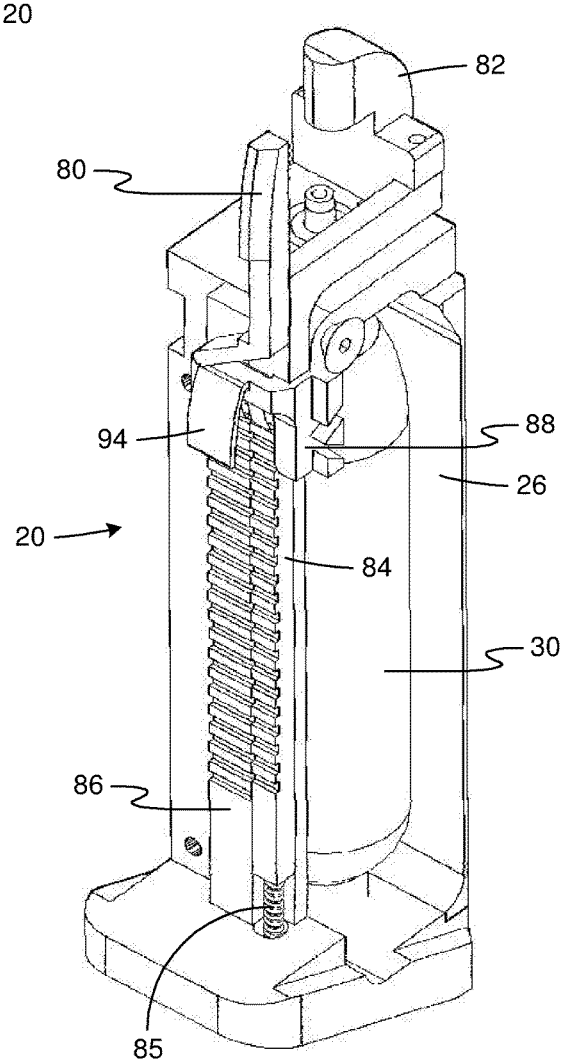
FIG. 16 is a perspective view of selected components of the magazine assembly of FIG. 15 wherein a magazine interface and a portion of the magazine frame are removed to expose an alternative embodiment of a counter in accordance with the present invention.
Figure 17:
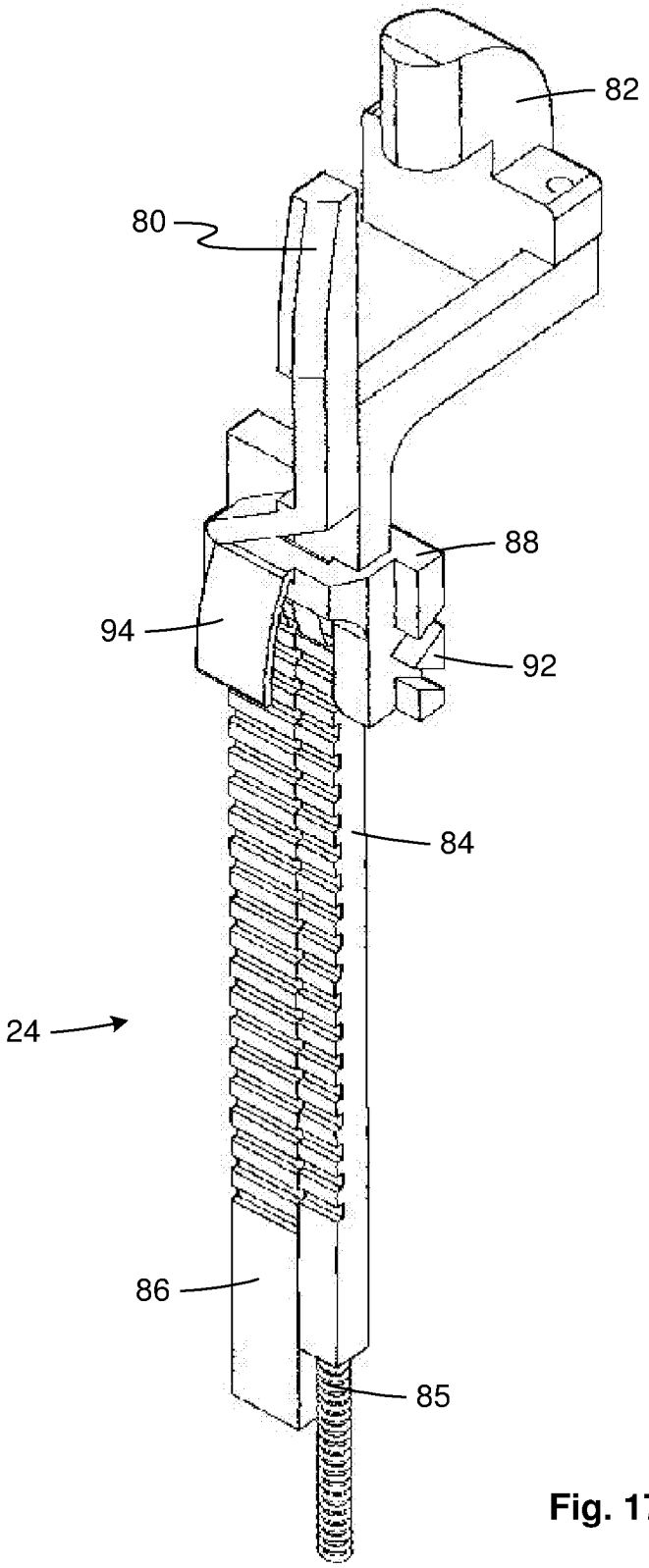
FIG. 17 is a perspective view of the counter of FIG. 16.
Figure 18:
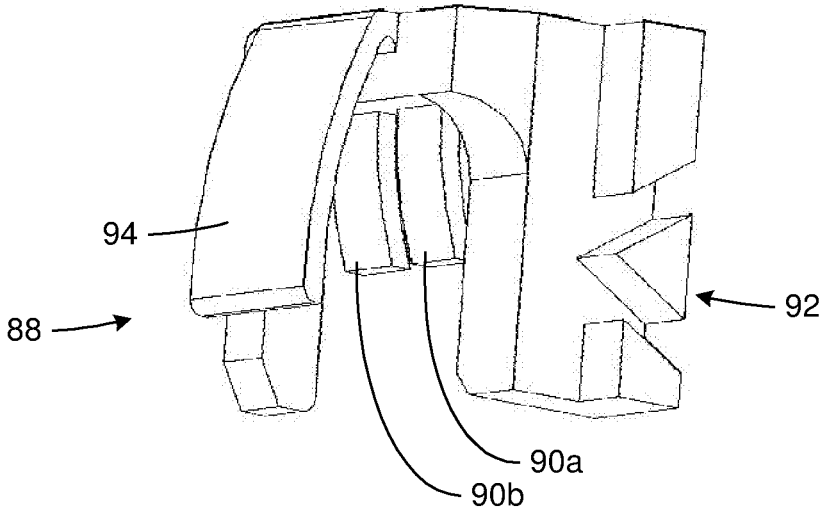
FIG. 18 is a perspective view of a traveler of the counter of FIG. 16.
Figure 19:
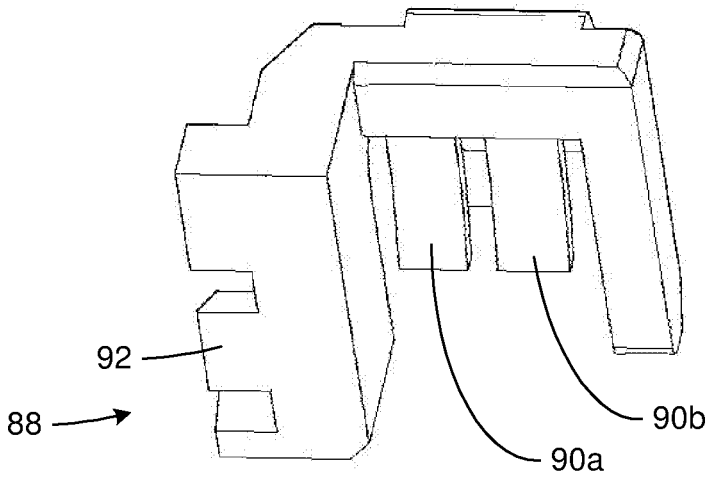
FIG. 19 is another perspective view of the traveler of FIG. 16.
Figure 20:
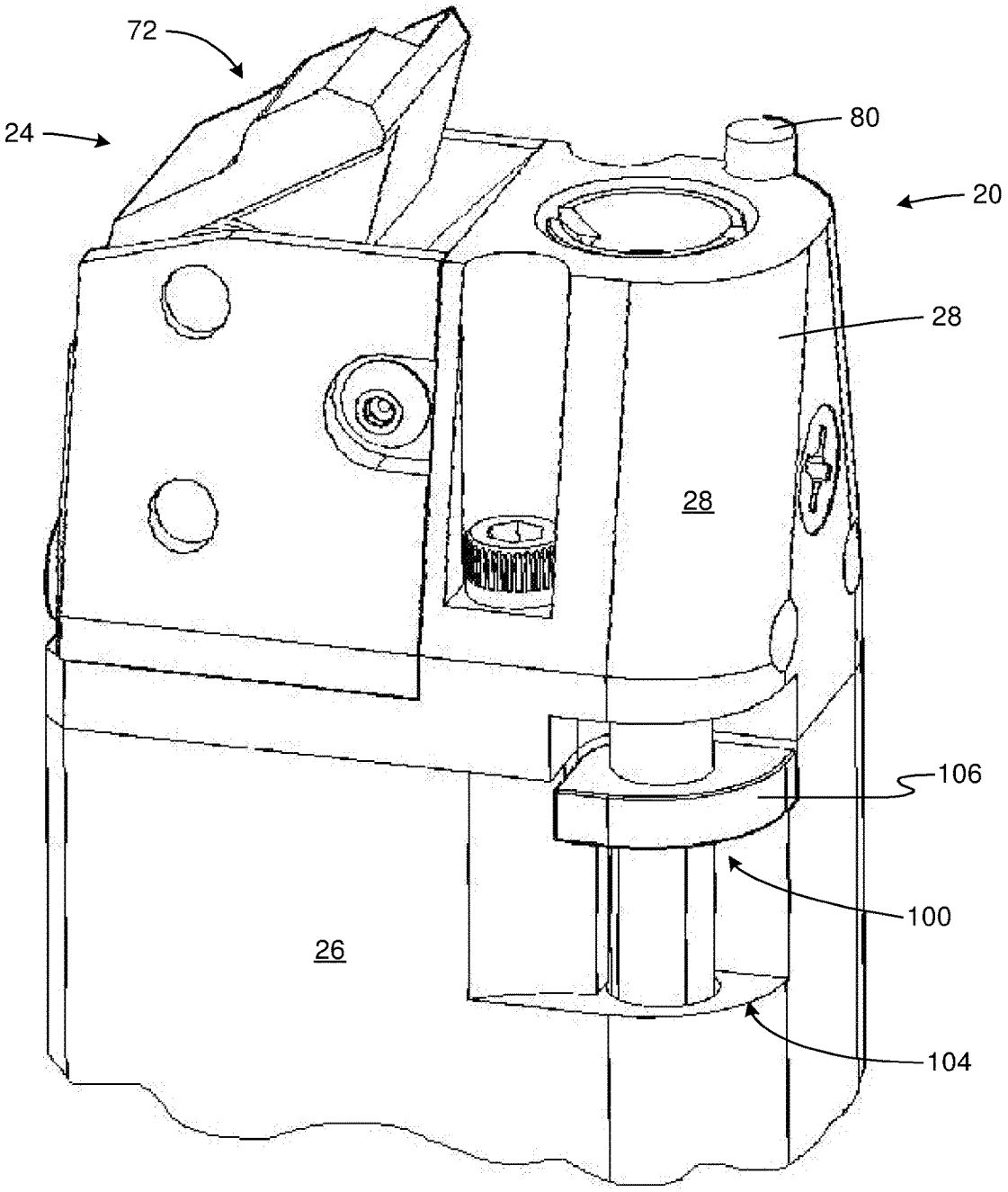
FIG. 20 is a first partial perspective view of an alternative embodiment of a magazine assembly in accordance with the present invention wherein the magazine assembly supports both "last shot hold open" and jam or malfunction simulation.
Figure 21:
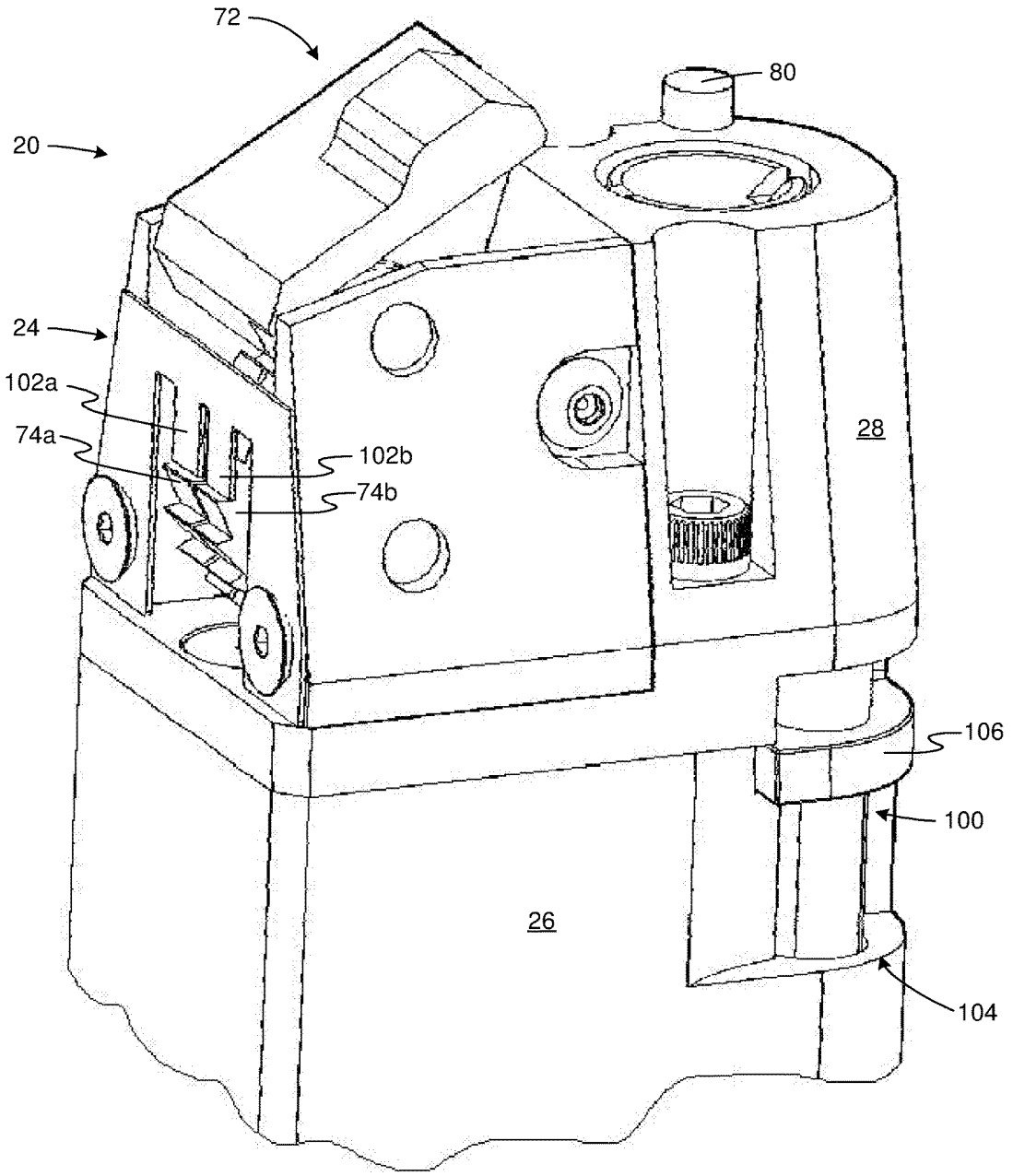
FIG. 21 is a second partial perspective view of the magazine assembly of FIG. 20.
Figure 22:
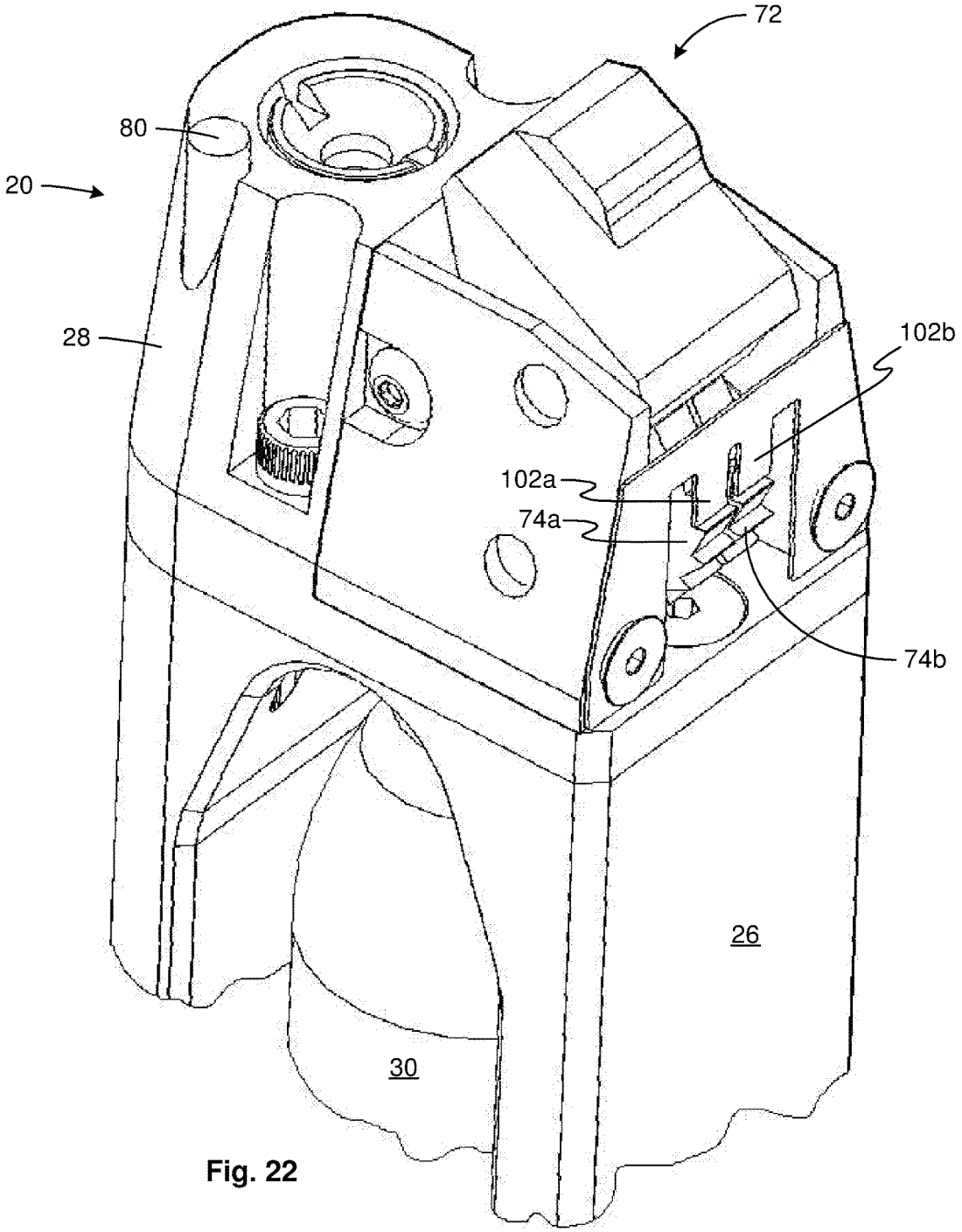
FIG. 22 is a third partial perspective view of the magazine assembly of FIG. 20.
Figure 23:
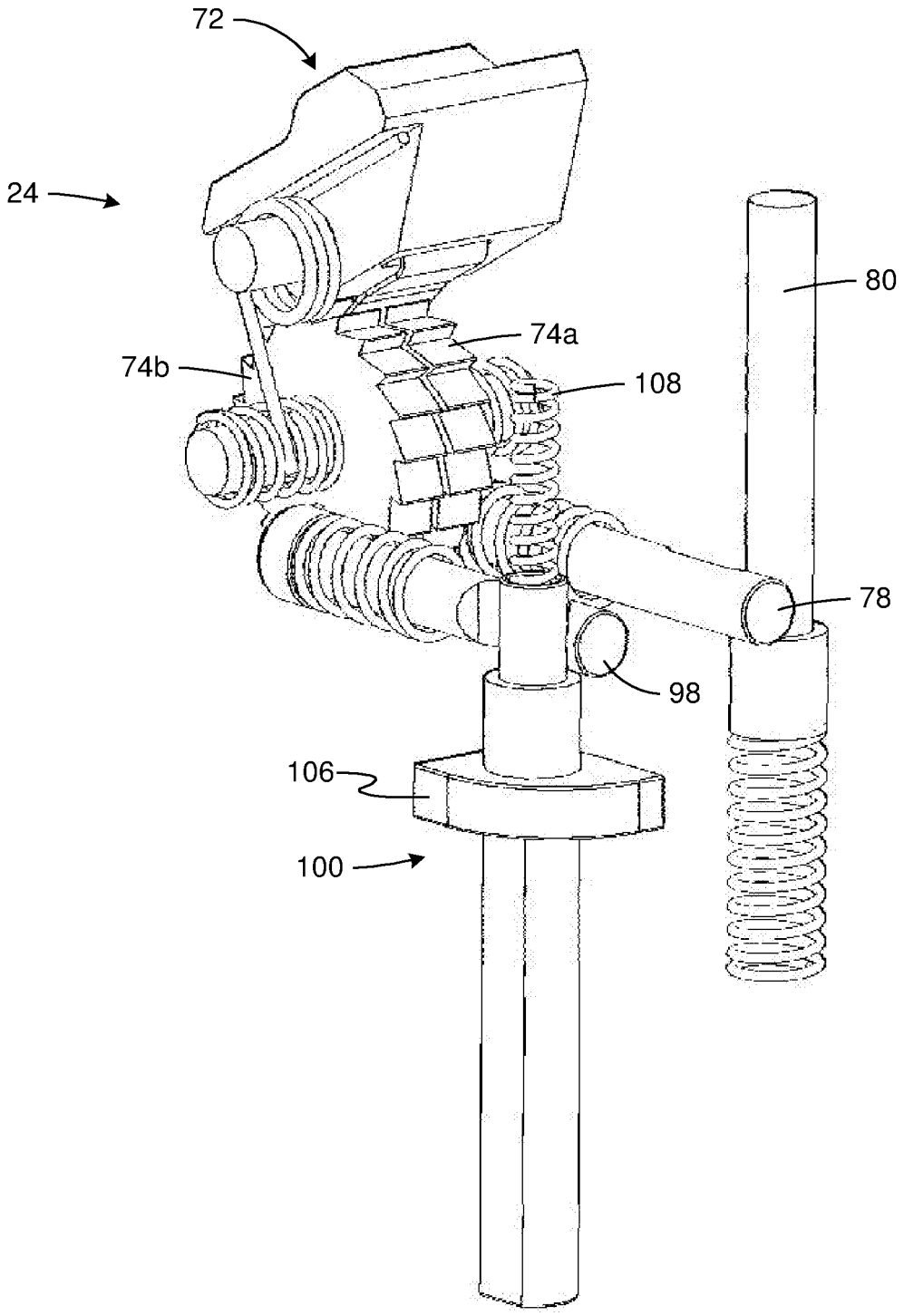
FIG. 23 is a first perspective view of the counter of the magazine assembly of FIG. 20 wherein the counter supporting both "last shot hold open" and jam or malfunction simulation.
Figure 24:
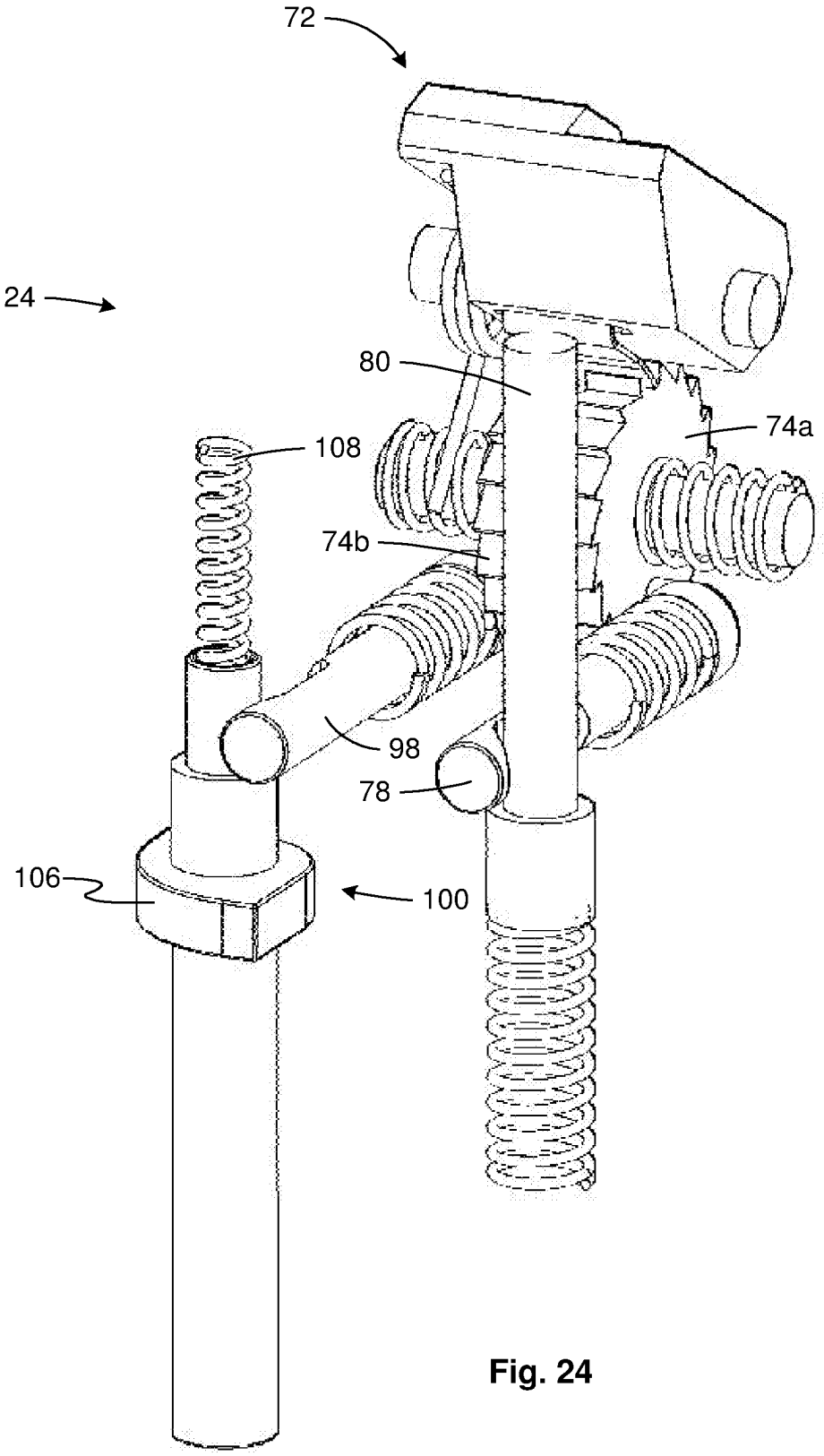
FIG. 24 is a second perspective view of the counter of the magazine assembly of FIG. 20.
Figure 25:
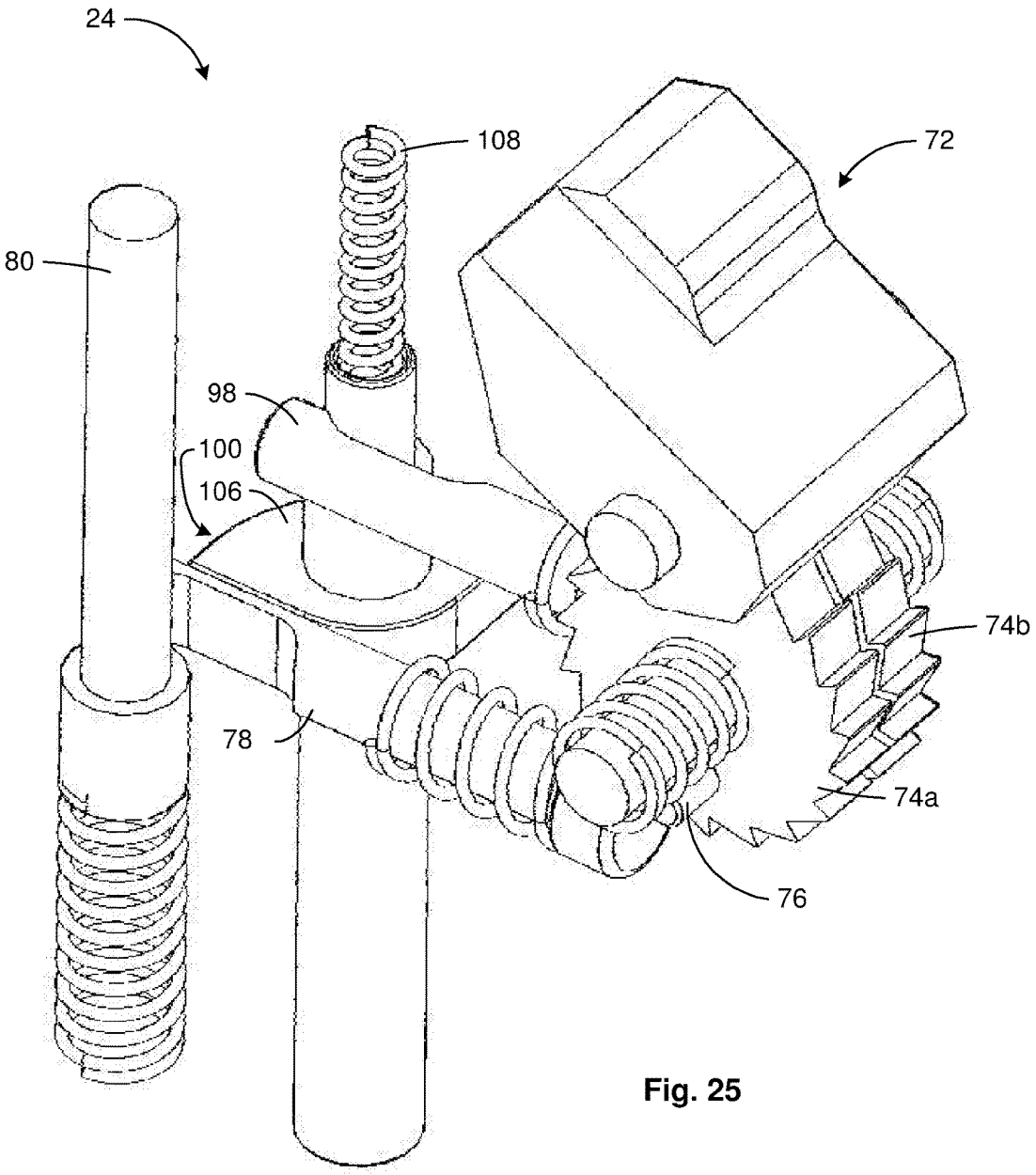
FIG. 25 is a third perspective view of the counter of the magazine assembly of FIG. 20.
Figure 26:
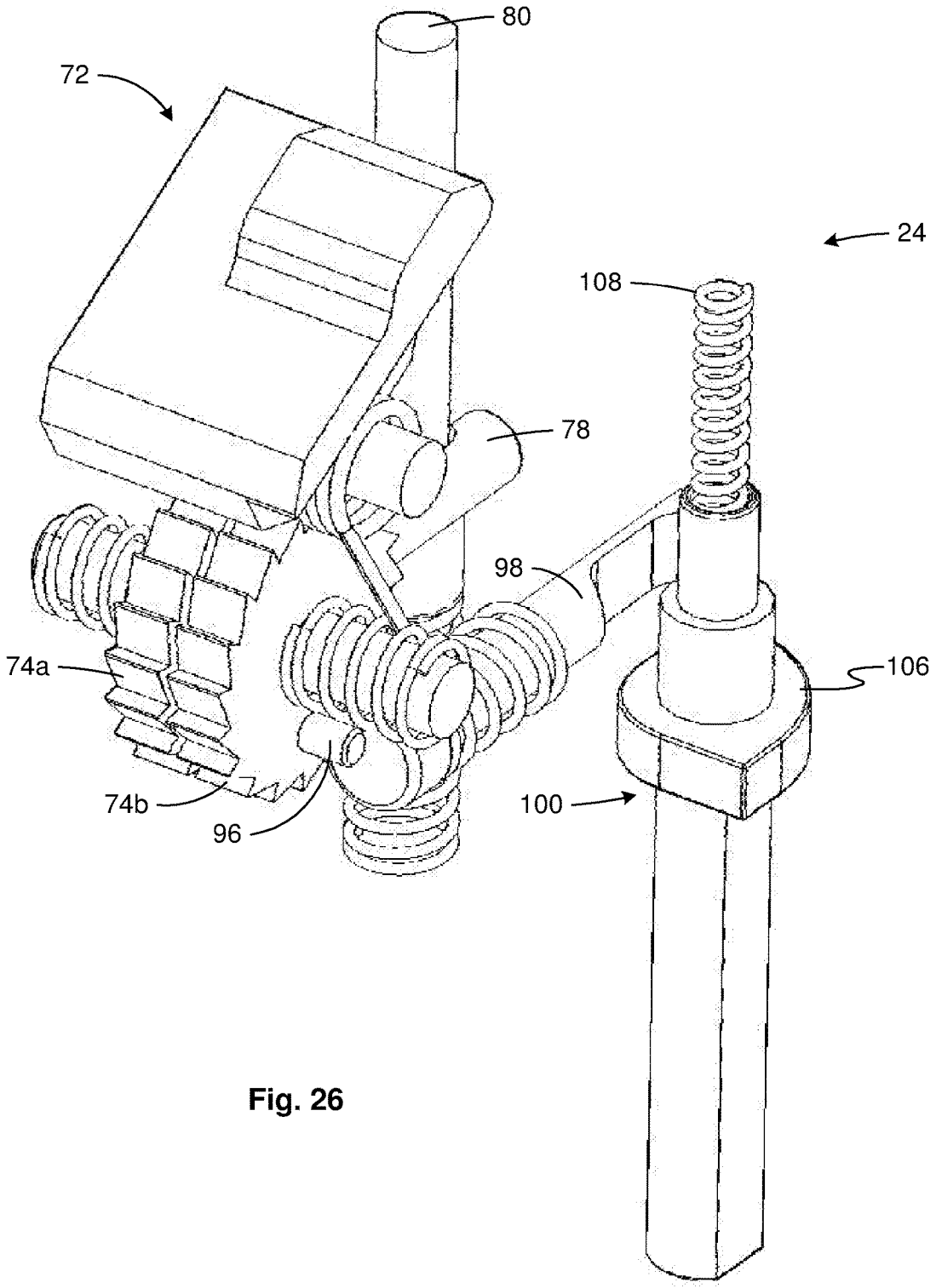
FIG. 26 is a fourth perspective view of the counter of the magazine assembly of FIG. 20.
Figure 27:
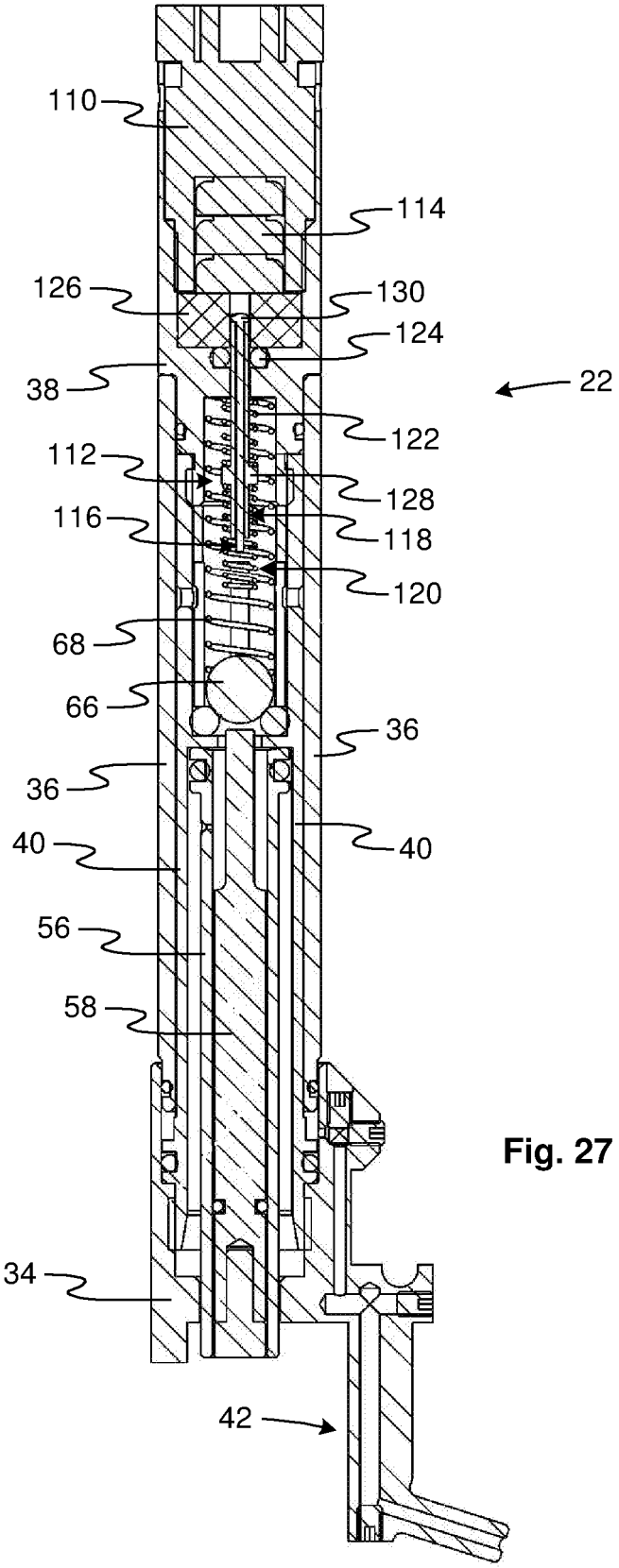
FIG. 27 is a side, cross-sectional view of an alternative embodiment of an actuator assembly wherein the actuator assembly is configured to emit a laser pulse during a simulated firing event.

Referring to FIG. 4, in selected embodiments, a magazine assembly 20 may include a penetrator 44 for piercing a seal of a container 30. A magazine assembly 20 may include various conduits 46 for conducting propellant received from a container 30 to a stem 42 of an actuator assembly 22. A magazine assembly 20 may include a valve 48 for controller the flow of propellant from a container 30 (e.g., once a seal of a container 30 has been pierced). A magazine assembly 20 may also include various seals 50.

For example, a magazine assembly 20 may include a container seal 50*a* for sealing around a mouth of a container 30, a valve seal 50*b* for engaging a traveler 52 of a valve 48, and a stem seal 50*c* for engaging the stem 42 of an actuator assembly 22. Thus, a magazine assembly 20 may provide a sealed and valved path through which propellant may travel to reach one or more apertures 54 or conduits 54 leading into an actuator assembly 22.

A valve 48 within a magazine assembly 20 may be actuated in any suitable manner. In selected embodiments, a traveler 52 may be biased by an biasing mechanism (e.g., a coil spring) toward engagement with a valve seal 52*b*. However, insertion of a stem 42 may unseat the traveler 52 and enable the flow of propellant from one or more containers 30 to an actuator assembly 22. Accordingly, when a magazine assembly 20 is not fully seated, no propellant may escape. Conversely, when a magazine assembly 20 is fully seated and a stem 42 is present, propellant may be conducted into an actuator assembly 22.

Referring to FIGS. 5-9, in selected embodiments, an actuator assembly 22 may include a base 34, inner cylinder 40, piston 56, firing pin extension 58, outer cylinder 36, end cap 38, reservoir 60, and reservoir valve 62. One or more seals 50*d* may seal a firing pin extension 58 with respect to a piston 56. One or more seals 50*e* may seal an inner cylinder 40 with respect to a base 34. One or more seals 50*f* may seal an outer cylinder 36 with respect to a base 34. One or more seals 50*g* may seal a piston 56 with respect to an inner cylinder 40. Accordingly, in certain embodiments, propellant (e.g., compressed fluid) received from a magazine assembly 20 may be conducted through various apertures 54 or conduits 54, through a gap 64 (e.g., a cylindrical gap) between the inner and outer cylinders 40, 36, and into a reservoir 60. A reservoir valve 62 may then prevent the propellant from escaping from the reservoir 60.

In selected embodiments, a reservoir valve 62 may include a traveler 66, seal 50*h*, and biasing member 68 (e.g., coil spring). A traveler 66 may be biased by a biasing mechanism 68 toward engagement with a seal 50*h*. However, actuation by a firing pin extension 58 may unseat a traveler 66 and enable propellant to escape from the reservoir 60 and actuate the piston 56.

In operation, before a trigger of a trigger assembly 18 is pulled, a magazine assembly 20 and actuator assembly 22 may be installed and a reservoir 60 may be charged with propellant. When the trigger is pulled, a firing pin of the training device 10 may strike a firing pin extension 58 causing it to move forward and open a reservoir valve 62. In selected embodiments, a firing pin extension 58 may be formed of a relatively light material (e.g., aluminum) to improve the movements and/or reactions associated with an impact by the firing pin of the training device 10.

With the reservoir valve 62 open, propellant may exist the reservoir 60 and act on a piston 56 causing it to extend. As the piston 56 extends, it may cycle the action of the training device 10 (e.g., urge a slide 16 or bolt 16 of a training device 10 backward, reset a trigger assembly 18, or the like). In selected embodiments, extension of a piston 56 may continue until a bumper 70 on the piston 56 contacts an opposing surface of a base 34. Further extension may thus be precluded.

At full extension, a gap between a piston 56, an inner cylinder 40, and a base 34 may enable propellant to escape the training device 10. In selected embodiments, this escape of propellant may be sufficiently voluminous and sharp to generate a significant popping noise that may provide a reasonable simulation of the report of a corresponding firearm.

In selected embodiments, the extension of a piston 56 may fully cycle the action of the training device 10. For example, the extension of a piston 56 may cause a slide 16 or bolt 16 to hit its stop. This impact may induce a motion of the training device 10 within the hands of a user that provides a reasonable simulation of the recoil of a corresponding firearm.

At some point, a recoil spring of a training device 10 may act to close the action of the training device 10. In selected embodiments, this motion may actuate or advance a counter 24 and/or return a piston 56 to an unextended or contracted position. Meanwhile, a reservoir valve 62 may have closed and a new charge of propellant may have been introduced into the reservoir 60. Accordingly, a subsequent pull of the trigger of a trigger assembly 18 may cause the process to repeat.

Referring to FIGS. 10-14, a counter 24 in accordance with the present invention may have any suitable arrangement. In selected embodiments, a counter 24 may be rotary. For example, in certain embodiments, a counter 24 may include a rocker 72, toothed wheel 74, driver 76, latch 78, and bolt lock 80. Movement of an action (e.g., a slide 16 or bolt 16) may actuate a rocker 72. Due to its interaction with a toothed wheel 74, the actuation of a rocker 72 may induce incremental rotation of the wheel 74. This incremental motion may be selected to correspond to a particular "number of shots" to be supported by the magazine assembly 20.

A driver 76 may be positioned on the wheel 74. Through much of its motion, a driver 76 may leave a latch 78 undisturbed. However, once a desired amount of incremental rotations of the wheel 74 have been induced by a rocker 72, a driver 76 may urge some motion of a latch 78 against a bias force. This motion of the latch 78 may release a bolt lock 80. Once released, a bolt lock 80 may move as biased and extend to engage a cycling slide 16, bolt 16, or the like and prevent the training device 10 from returning to battery (e.g., prevent the action of the training device 10 from closing). Thus a counter 24 may simulate a "last shot hold open" feature commonly found on many firearms.

Referring to FIGS. 15-19, in selected embodiments, a counter 24 may be linear. For example, in certain embodiments, a counter 24 may include a ramp 82, traveling toothed member 84, biasing member 85, stationary toothed member 86, traveler 88, and bolt lock 80. Movement of an action (e.g., cycling of a slide 16 or bolt 16) may actuate a ramp 82 up and down. Due to its connection with a ramp 82, the downward actuation of a ramp 82 may incrementally ratchet a traveling tooth member 84 through a first one-way gate 90*a* of the traveler 88. A biasing member 85 may then urge the traveling toothed member 84 back up. Accordingly, the traveling toothed member 84 may incrementally ratchet a stationary toothed member 86 through a second one-way gate 90*b* of the traveler 88. Thus, with each cycle of a slide 16 or bolt 16, a traveler 88 may climb one step up a stationary toothed member 86. This incremental motion of a traveler 88 may continue until the travel 88 contacts a bolt lock 80 and urges it into engagement with a cycling slide 16, bolt 16, or some other portion of an action, thereby preventing or blocking the action of the training device 10 from closing or returning to battery.

To reset such a counter 24, a user may engage an exposed portion 92 of the traveler 88 to compress a biasing member 94 thereof and remove the first and second one-way gates 90*a*, 90*b* from engagement with the traveling and stationary toothed members 84, 86. Once the first and second one-way gates 90*a*, 90*b* are disengaged, the traveler 88 may be reset (lowered) so that is can again ascend the stationary toothed member 86.

In selected embodiments, some exterior portion of a magazine assembly 20 may include indexing marks 93, notations 93, or numbers 93. An exposed portion 92 of a traveler 88 may be or comprise a pointer interacting with the indexing marks 93, notations 93, or numbers 93. Accordingly, by visually inspecting a magazine assembly 20, a user may be able to determine or select a number of cycles before a bolt lock 80 will be deployed. For example, a user may engage an exposed portion 92 of the traveler 88 to compress a biasing member 94 as discussed hereinabove, then lower the traveler 88 until an exposed portion 92 of the traveler 88 points to an indexing mark 93, notation 93, or number 93 corresponding to a desired number of cycles. Once the traveler 88 is released at that location, the magazine assembly 20 may be set to permit the desired number of cycles before further cycling is stopped.

Referring to FIGS. 20-26, in selected embodiments, a counter 24 in accordance with the present invention may assist in simulating a firearm malfunction. For example, in certain embodiments, a counter 24 may include a first system, a second system, or both a first system and a second system. As discussed hereinabove, a first system (e.g., a system comprising a rocker 72, toothed wheel 74, driver 76, latch 78, and slide lock 80) may simulate or provide a "last shot hold open." As discussed hereinbelow, a second system may simulate or provide a jam or firearm malfunction that requires a user to execute and practice a jam or malfunction clearing drill (e.g., a "tap and rack" drill).

A second system may be formed in any suitable manner. In selected embodiments, a second system may share one or more components with a first system. For example, in selected embodiments, first and second systems may share a rocker 72. Additionally, first and second systems may share a toothed wheel 74. Alternatively, a first system may include a first toothed wheel 74*a*, while a second system includes a second toothed wheel 74*b*. A second system may further include one or more drivers 96, a latch 98, and a magazine lock 100.

Movement of an action (e.g., cycling of a slide 16 or bolt 16) may actuate a rocker 72. Due to the interaction between a rocker 72, a first toothed wheel 74*a*, and a corresponding ratchet mechanism 102*a* or one way gate 102*a*, actuation of a rocker 72 may induce unidirectional, incremental rotation of the first wheel 74*a*. This rotation may be used to control a "last shot hold open" feature of a magazine assembly 20 as discussed hereinabove. In a similar manner, interaction between a rocker 72, second toothed wheel 74*b*, and a corresponding ratchet mechanism 102*b* or one way gate 102*b* may induce unidirectional, incremental rotation of the second wheel 74*b*. As discussed hereinbelow, this rotation may be used to control a simulated jam or malfunction.

In selected embodiments, a first wheel 74*a* may be substantially identical to a second wheel 74*b*. Alternatively, a first wheel 74*a* may be different from a second wheel 74*b*. For example, a first wheel 74*a* may have a different number of teeth than a second wheel 74*a*. Accordingly, actuation of a rocker 72 may induce one amount of rotation in a first wheel 74*a* and a different amount of rotation in a second wheel 74*b*.

In certain embodiments, one or more drivers 96 may be positioned on a second wheel 74*b*. For certain stretches of relative motion therebetween, a driver 96 may leave a latch 98 undisturbed. However, once a desired amount of incremental rotation of the wheel 74*b* has been induced by a rocker 72, a driver 96 may urge some motion of a latch 98 against a bias force. This motion of the latch 98 may release a magazine lock 100.

In selected embodiments, release of a magazine lock 100 may change the size of an indentation 104 or recess 104 engaged by a magazine release. For example, release of a magazine lock 100 may result in a blocking element 106 that connects to or forms part of a magazine lock 100 moving upward, thereby enlarging an indentation 104 or recess 104 engaged by a magazine release.

At first glance, the upward bias of a magazine lock 100 and corresponding blocking element 106 may seem counter intuitive (particularly considering the oppositely oriented bias produced by a reset spring 108). However, gas pressure within a stem 42 and the conduits 54 associated therewith may produce a significant force urging a magazine assembly 20 out of a magazine well of a training device 10. A magazine release may resist this force by extending into the indentation 104 or recess 104 and abutting a blocking element 106.

Accordingly, release of a magazine lock 100 may produce no relative motion between a magazine lock 100, blocking element 106, frame 14, and magazine release. However, such a release may free the rest of a magazine assembly 20 to move as biased by the pressurized fluid. Thus, when a magazine lock 100 is released, a magazine assembly 20 may drop from a first position to a second position.

In selected embodiments, this drop may disengage a stem 42 from a magazine assembly 20 and de-gas or vent the actuator assembly 22. Accordingly, while a magazine assembly 20 occupies the second position, an actuator assembly 22 may be unable to produce a simulated firing event. A user may pull the trigger of a trigger assembly 18, but no simulated firing will occur.

In selected embodiments, to clear such a simulated jam or malfunction, a user may execute a "tap and rack" drill. A tap and rack drill may remedy a variety of common firearm jams or malfunctions and return a firearm (and corresponding training device 10) to action. In a tap and rack drill, a user "taps" a magazine assembly 20 (a protruding portion of a magazine assembly 20) to ensure that it is seated properly within a magazine well and then "racks" a slide 16 or bolt 16.

In selected embodiments, by "tapping" a magazine assembly 20 occupying a second position, a user may cause a stem 42 to re-engage the magazine assembly 20, overcome the opposing force caused by the pressurized fluid, and enable a magazine lock 100 to be reset. In certain embodiments, such a reset may be aided or assisted by a reset spring 108.

Tapping may thus result in an actuator assembly 22 being recharged with pressurized gas. However, the training device 10 is not likely to be cocked (pulling the trigger and getting no "bang" was likely what alerted the user to a problem in the first place). Accordingly, before the training device 10 can be fired again, the slide 16 or bolt 16 must be "racked." Thus, a counter 24 in accordance with the present invention may require a complete "tap and rack" before the training device 10 may be returned to action.

Figure 28:
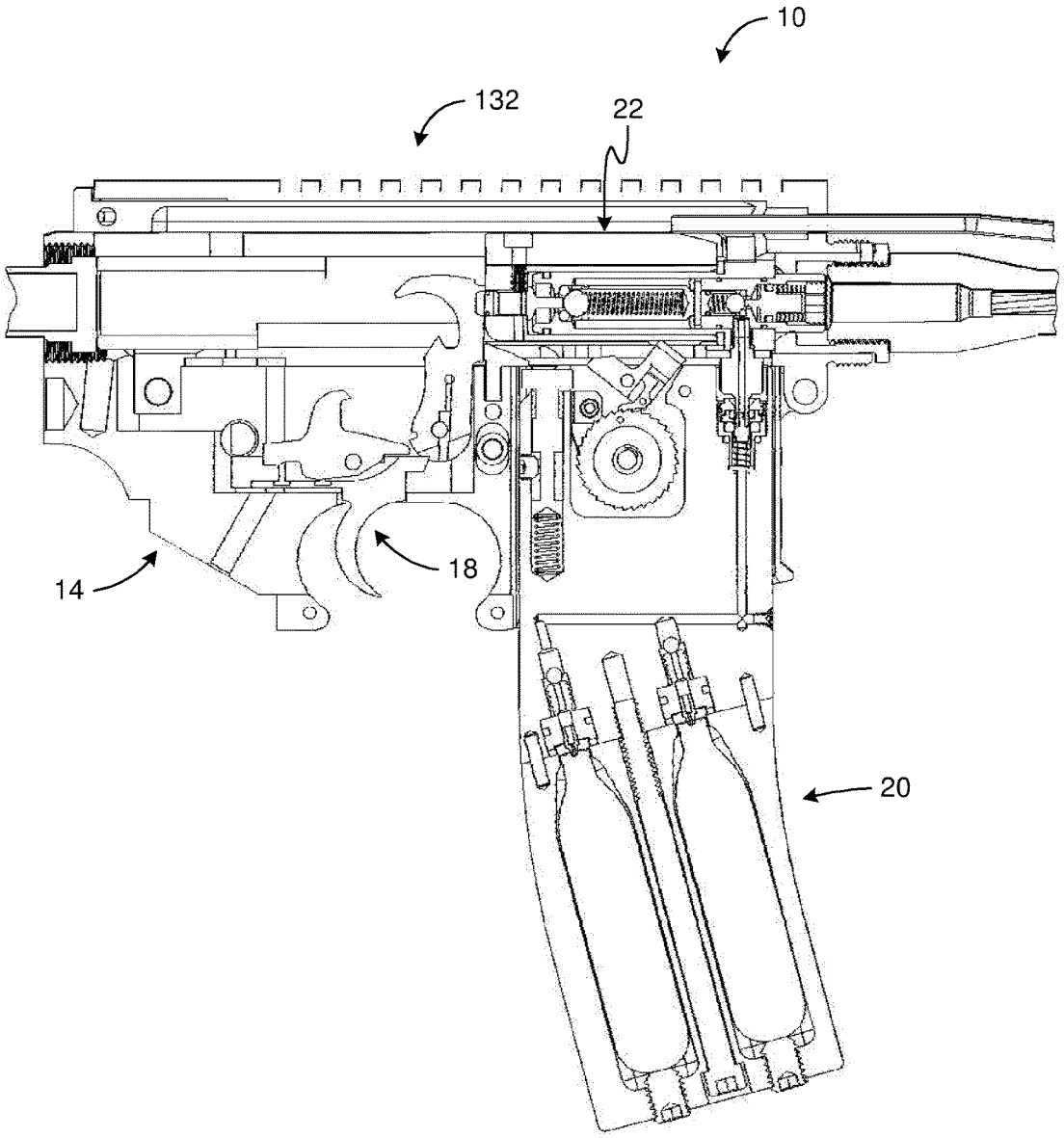
FIG. 28 is a partial, side, cross-sectional view of another embodiment of a pneumatic training device in accordance with the present invention.

Referring to FIG. 28, in selected embodiments, an actuator assembly 22 in accordance with the present invention may emit a laser pulse during a simulated firing event. Moreover, in certain embodiments, an actuator assembly 22 may be configured to emit a laser pulse only when properly triggered and not inadvertently when the unit 10, 22 is dropped, the slide 16 or bolt 16 is racked, or the like. This may be accomplished in any suitable manner. For example, in selected embodiments, it may be accomplished using a laser assembly comprising a laser emitter 110 and a selectively movable probe assembly 112.

A laser emitter 110 may include one or more batteries 114. In selected embodiments, a laser emitter 110 may emit a laser beam whenever a proper electrical circuit involving the batteries 114 is made. The duration of a laser beam may correspond to the duration of the electrical circuit. Thus, if the electrical circuit is maintained for a short period of time, a laser emitter 110 may effectively emit a laser pulse (as opposed to a steady beam).

In selected embodiments, a probe assembly 112 may include a probe 116, probe sleeve 118, first inner spring 120, second inner spring 122, probe seal 124, and insulating disk 126. A probe 116 may be electrically conductive. A probe sleeve 118 may form an electrically insulating cover for a probe 116. A probe sleeve 118 may be substantially fixed with respect to a probe 116 and move therewith. In certain embodiments, a probe sleeve 118 may include a shoulder 128 against which a first inner spring 120, a second inner spring 122, or both the first inner spring 120 and the second inner spring 122 may act.

A first inner spring 120 may provide a mechanical and electrical interface between a traveler 66 and a probe 116. A second inner spring 122 may bias a probe sleeve 118 and corresponding probe 116 toward a traveler 66 and away from contact with a laser emitter 110. A probe seal 124 may prevent pressurized gas from escaping around a probe sleeve 118 as it extends out of a reservoir 60 toward a laser emitter 110. An insulating disk 126 may prevent the formation of an unwanted electrical short between a probe 116 (e.g., a probe tip 130) and a laser emitter 110.

Preparatory to a laser firing event, a reservoir 60 may be charged with compressed gas. So pressurized, a traveler 66 may be firmly seated against a corresponding seal **50*h*. Additionally, the differential in the pressures applied to the various surfaces of a probe 116 and probe sleeve 118 may overcome a biasing effect of a second inner spring 122 and firmly seat a probe 116 (e.g., a probe tip 130) against a desired portion of a laser emitter 110. With the traveler 66 and probe 116** so separated, no electrical circuit may be made.

During a firing event, a traveler 66 may be impacted by a firing pin extension 58 and move against the bias of a biasing member 68 forward into a reservoir 60. At some point in this forward motion, the traveler 66 may contact a first inner spring 120, which may be electrically connected in some manner to a probe 116, thereby forming an electrical circuit. This electrical circuit may be used or interpreted by a laser emitter 110 as a triggering event or input. Accordingly, in response to the making of an electrical circuit, a laser emitter 110 may begin emitting a laser beam.

That is, a laser emitter 110 may have an internal microcontroller for making a laser pulse. This may enable a laser emitter 110 to emit high frequency "coded" laser pulses that are specific thereto so that a receiving device can identify individual training devices 10. Thus, the completion of an electrical circuit may be used as an input to a microcontroller to initiate a laser cycle.

Eventually, the biasing force of a biasing member 68 may stop the forward motion of the traveler 66 and the traveler 66 may begin moving back toward the seal **50*h* corresponding thereto. At some point in this rearward motion, the traveler 66 may break contact with the first inner spring 120**, thereby breaking the electrical circuit.

In selected embodiments, a laser emitter 110 may be grounded to a barrel tip 38. Accordingly, in certain embodiments, when an electrical circuit is made it may extend from a "first terminal" of a laser emitter 110, through a barrel tip 38, biasing member 68, traveler 66, first inner spring 120, and probe 116, to a "second terminal" of the laser emitter 110.

Pressurized gas within a charged reservoir 60 may separate a traveler 66 and a first inner spring 120. Thus, no electrical circuit may be made and no laser pulse emitted. Conversely, when a reservoir 60 is not pressurized, a second inner spring 122 may bias a probe 116 out of contact with a laser emitter 110. Accordingly, even if a traveler 66 where to inadvertently contact a first inner spring 120, no electrical circuit may be made and no laser pulse emitted. Thus, only in a proper triggering event can an electrical circuit be made and a laser pulse emitted.

Figure 29:
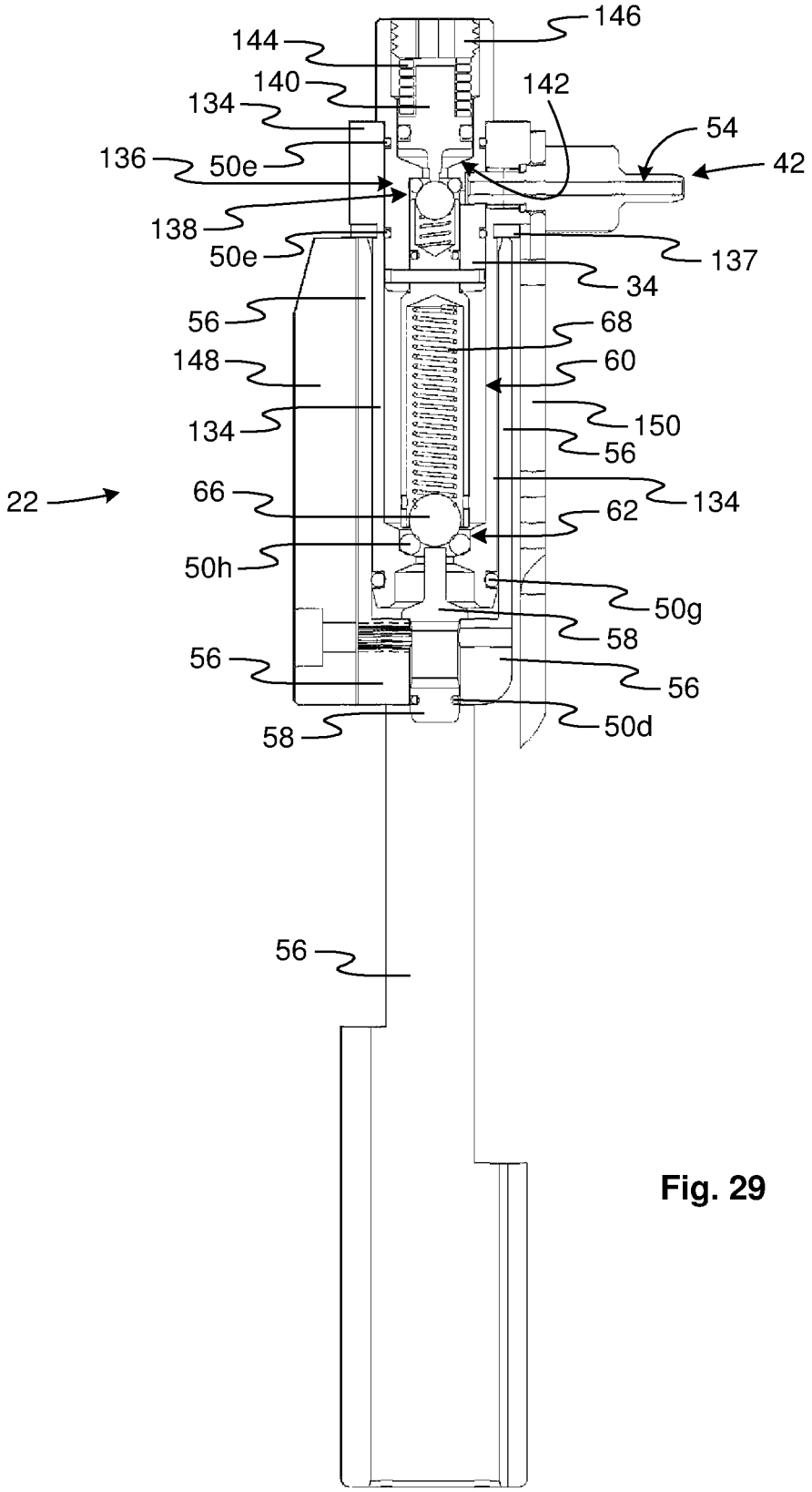
FIG. 29 is a side, cross-sectional view of an actuator assembly of the training device of FIG. 28.
Figure 30:
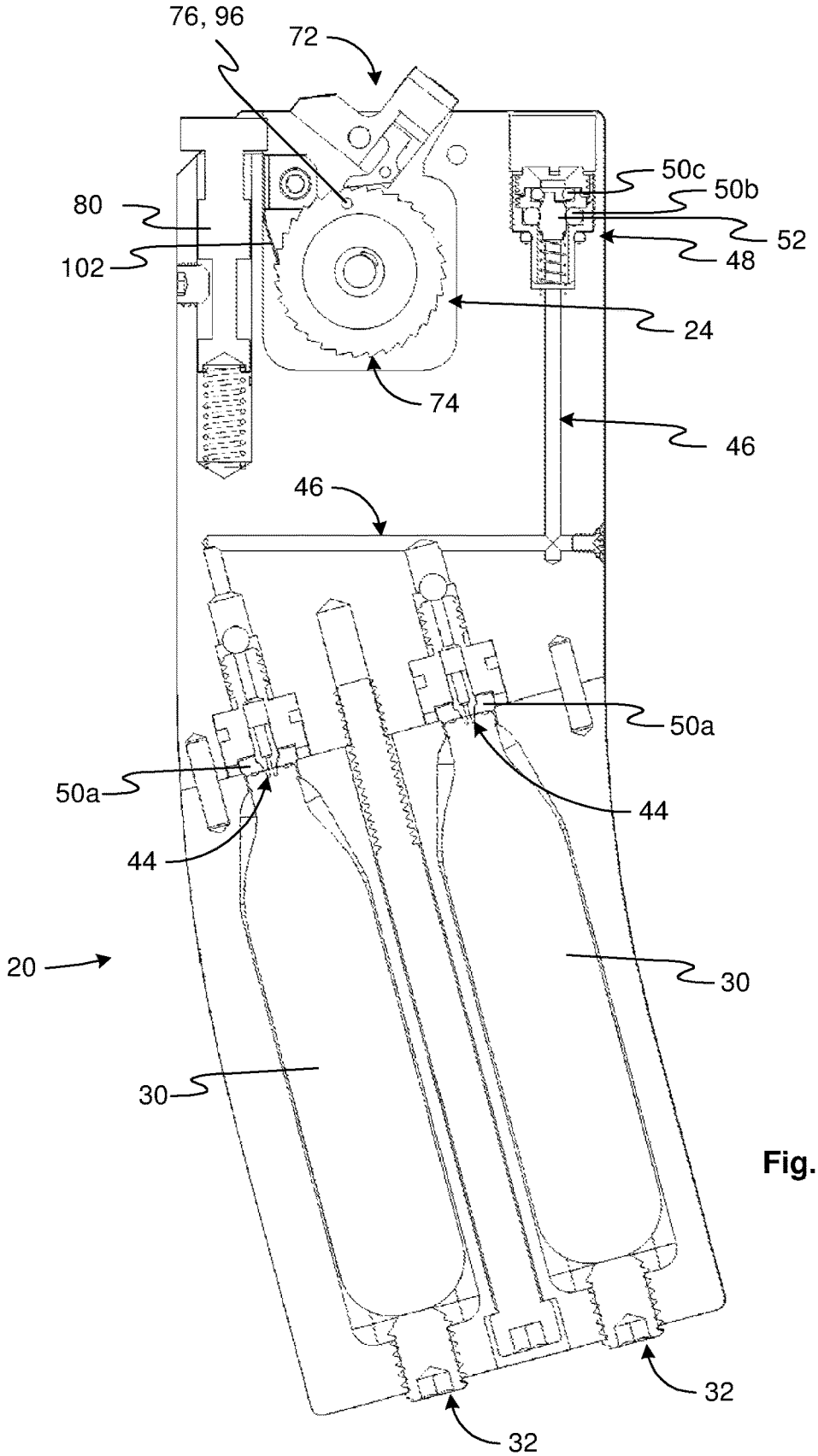
FIG. 30 is a side, cross-sectional view of a magazine assembly of the training device of FIG. 28.

Referring to FIGS. 28-30, magazine and actuator assemblies 20, 22 in accordance with the present invention may have any suitable configurations. They may also be positioned or substituted within a firearm in any suitable locations. While the illustrations discussed above show magazine and actuator assemblies 20, 22 sized and shaped for substitution into an automatic pistol 12 in place of a magazine and barrel thereof, other sizes and shapes are contemplated.

For example, in selected embodiments, a training device 10 may be built from or comprise various components, assemblies, or sub-systems of a rifle 132 (e.g., an AR-15 type rifle or variants thereof), including a frame 14 (e.g., upper and lower receivers), trigger assembly 18, and the like. In such embodiments, a magazine assembly 20 may replace a conventional magazine. Rather than replacing a barrel like in certain other embodiments, however, an actuator assembly 22 may replace a bolt 16, bolt carrier group, some other portion of an action, or the like.

In certain embodiments, a magazine assembly 20 adapted for use in a rifle-based training device 10 may store more propellant than a magazine assembly 20 adapted for use in pistol-based training device 10. More propellant may be required to cycle a rifle-based training device 10. Additionally, more propellant may enable a training device 10 to complete more cycles (e.g., 30 cycles simulating a 30 round magazine). Accordingly, a magazine assembly 20 may include a larger container 30 or multiple containers 30.

While the sizes, shapes, weights, and the like of a counter 24 of a magazine assembly 20 adapted for use in a rifle-based training device 10 may different (e.g., larger, stronger, heavier, or the like) than those of a counter 24 for a magazine assembly 20 adapted for use in pistol-based training device 10, the functionality may be similar. For example, as in other embodiments, a counter 24 may include a rocker 72, toothed wheel 74, driver 76, latch 78 (not shown), and bolt lock 80.

Movement (e.g., cycling) produced by an actuator assembly 22 may actuate a rocker 72. Due to the interaction between a rocker 72, a toothed wheel 74, and a corresponding ratchet mechanism 102 or one way gate 102, actuation of a rocker 72 may induce unidirectional, incremental rotation of the wheel 74. This rotation may be used to control a "last shot hold open" feature of a magazine assembly 20 as discussed hereinabove. However, rather than extending to stop or block a slide 16 or bolt 16, a bolt lock 80 may extend to stop or block a portion of an actuator assembly 20, which may have taken the place of a bolt 16 or bolt carrier group. Alternatively, or in addition thereto, rotation of a wheel 74 may be used to control a simulated jam or malfunction as discussed hereinabove. Accordingly, as in other embodiments, a counter 24 adapted for use in a rifle-based training device 10 may include a first system, a second system, or both a first system and a second system.

In selected embodiments, an actuator assembly 22 adapted for use in a rifle-based training device 10 may include a base 34, a cylinder 134 (e.g., a structure performing functionality that may be associated with one or both of an inner cylinder 40 and an outer cylinder 36), piston 56, firing pin extension 58, reservoir 60, and reservoir valve 62. One or more seals **50*d* may seal a firing pin extension 58 with respect to a piston 56. One or more seals 50*e* may seal an cylinder 134 with respect to a base 34. One or more seal 50*g* may seal a piston 56 with respect to a cylinder 134**.

Accordingly, in certain embodiments, propellant (e.g., compressed fluid) received from a magazine assembly 20 may be conducted through various apertures 54 or conduits 54, through a regulator 136 and into a reservoir 60. A reservoir valve 62 may then prevent the propellant from escaping from the reservoir 60.

In operation, before a trigger of a trigger assembly 18 is pulled, a magazine assembly 20 and actuator assembly 22 may be installed and a reservoir 60 may be charged with propellant. When the trigger is pulled, a firing pin of the training device 10 may strike a firing pin extension 58 causing it to move forward and open a reservoir valve 62. With the reservoir valve 62 open, propellant may exist the reservoir 60 and act on a piston 56 causing it to extend (e.g., move rearward within the training device 10).

As the piston 56 extends, it may cycle the action of the training device 10 (e.g., reset a trigger assembly 18). In selected embodiments, extension or movement of a piston 56 may continue even after a piston 56 has exited a cylinder 134. For example, in certain embodiments, a piston 56 may continue rearward under its own inertia until it is stopped and returned to battery by a recoil spring (e.g., a buffer tube or one or more biasing members contained therewithin).

At full extension, a gap between a piston 56 and cylinder 134 may enable propellant to escape the training device 10. In selected embodiments, this escape of propellant may be sufficiently voluminous and sharp to generate a significant popping noise that may provide a reasonable simulations of the report of a corresponding firearm.

At some point, a recoil spring of a training device 10 may act to close the action of the training device 10. In selected embodiments, this motion may actuate or advance a counter 24 and/or return a piston 56 to an unextended or contracted position. A buffer 137 (e.g., a buffer 137 forming part of a cylinder 134) may define and cushion a contact or stopping point as a piston 56 returns to battery. Meanwhile, a reservoir valve 62 may have closed and a new charge of propellant may have been introduced into the reservoir 60. Accordingly, a subsequent pull of the trigger of trigger assembly 18 may cause the process to repeat.

In certain embodiments, an actuator assembly 22 may include an adjustable regulator 136 regulating a flow of gas. Such a regulator 136 may have any suitable configuration. For example, in selected embodiments, a regulator 136 may include a reservoir valve 138 and a biased piston 140. A face of a biased piston 140 may form one wall of a chamber 142. Such a chamber 142 may be in fluid communication with a reservoir 60 (e.g., via one or more axial apertures extending through a base 134 that are not shown in the cross-section views of FIGS. 28-30). Accordingly, a pressure in a chamber 142 may be the same as a pressure within a reservoir 60. Additionally, in selected embodiments, a chamber 142 may be considered to be part of (e.g., contribute to the volumetric capacity of) a reservoir 60.

When a pressure within a chamber 142 is too low compared to a biasing force applied to a biased piston 140 by a biasing member 144 and adjuster 146, then a biased piston 140 may move as biased to open a reservoir valve 138. With a reservoir valve 138 open, compressed fluid may flow through one or more conduits 54 or apertures 54 of a stem 42, through the reservoir valve 138, and into a chamber 142. This may increase the pressure within the chamber 142.

When the pressure within a chamber 142 is sufficiently high to overcome a bias applied to a biased piston 140, the biased piston 140 may move away from a reservoir valve 138, enabling the reservoir valve 138 to close. In this manner, the pressure of a compressed fluid within a reservoir 60 may be regulated. Moreover, by changing the position of an adjuster 146, a user or technician may tune an actuator assembly 22 to function properly within the particular frictional loads and the like associated with the corresponding training device 10.

In addition to one or more subsystems or components discussed hereinabove, an actuator assembly 22 may have other components or structures for adapting the actuator assembly 22 to a particular firearm. For example, as shown in the illustrated embodiment, an actuator assembly 22 may include a charging guide 148 and an alignment plate 150. These structures may address issues associated with AR-15 type rifles. A charging guide 148 may move with a piston 56 and provide a location for a charging handle to engage and manipulate (e.g., pull back or rack) a piston 56. An alignment plate 150, on the other hand, may hold an actuator assembly 22 in its proper location, even when a lower receiver is separated from an upper receiver. Thus, magazine and actuator assemblies 20, 22 in accordance with the present invention may be adapted to a wide variety of firearms.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A training method comprising:

cycling a pneumatic training device through one or more cycles, each of the one or more cycles comprising triggering a trigger assembly of the pneumatic training device, using a charge of a pressurized fluid to reset the trigger assembly, and advancing a counter of the pneumatic training device, the counter comprising a toothed wheel, a driver extending eccentrically from a lateral surface of the toothed wheel, a latch, and a lock biased toward a deployed position;

moving, by the toothed wheel during the advancing associated with a last cycle of the one or more cycles, the driver toward the lock;

pushing, by the driver during the moving, the latch out of engagement with the lock to free the lock to move as biased; and preventing, by the lock after the pushing, the pneumatic training device from returning to a ready-to-fire condition.

2. The training method of claim 1, wherein the preventing comprises the lock translating to the deployed position and mechanically blocking the pneumatic training device from returning to battery.

3. The training method of claim 1, wherein:

the pneumatic training device comprises a bolt; and the preventing comprises the lock moving to the deployed position and mechanically blocking the bolt from returning to battery.

4. The training method of claim 3, wherein:

the pneumatic training device comprises a magazine well and a magazine assembly positioned within the magazine well; and the counter forms part of the magazine assembly.

5. The training method of claim 1, wherein:

the pneumatic training device comprises a magazine well and a magazine assembly positioned within the magazine well; and the preventing comprises the lock moving to the deployed position and releasing the magazine assembly from a fully seated position within the magazine well.

6. The training method of claim 5, wherein the releasing vents an amount of the pressurized fluid from the pneumatic training device.

7. The training method of claim 6, further comprising returning the pneumatic training device to the ready-to-fire condition by executing a tap and rack drill.

8. A training method comprising:

selecting a firearm comprising a trigger assembly and a magazine well;

converting the firearm into a training device by installing a magazine assembly within the magazine well, the magazine assembly comprising a counter and a container containing a fluid propellant under pressure, and installing an actuator assembly within the firearm;

cycling the training device through one or more cycles, each of the one or more cycles simulating an actual firing of the firearm and comprising passing a charge of the fluid propellant from the container to the actuator assembly, triggering the trigger assembly, using, by the actuator assembly in response to the triggering, the charge to reset the trigger assembly, and advancing the counter;

attempting, after completing the one or more cycles, a next cycle of the training device; and preventing, by the counter, the training device from completing the next cycle by releasing the magazine assembly from a fully seated position within the magazine well.

9. The training method of claim 8, wherein the preventing comprises venting an amount of the fluid propellant from the actuator assembly.

10. The training method of claim 9, further comprising returning the training device to the ready-to-fire condition by executing a tap and rack drill.

11. A training method comprising:

obtaining a training device comprising a trigger assembly, a magazine well, and a magazine assembly fully seated within the magazine well;

cycling the training device through one or more cycles, each of the one or more cycles comprising triggering the trigger assembly, using a charge of a pressurized fluid to reset the trigger assembly, and advancing a counter of the training device;

attempting, after completing the one or more cycles, a next cycle of the training device; and preventing, by the counter, the training device from completing the next cycle by releasing the magazine assembly from the fully seated position within the magazine well.

12. The training method of claim 11, wherein the preventing comprises venting an amount of the pressurized fluid from the training device.

13. The training method of claim 11, further comprising returning the training device to a ready-to-fire condition by executing a tap and rack drill.

* * * * *